US008505214B2

(12) United States Patent
Lee

(10) Patent No.: US 8,505,214 B2
(45) Date of Patent: Aug. 13, 2013

(54) ARTICLE OF FOOTWEAR

(76) Inventor: Ka Shek Neville Lee, Sai Kung (HK)

( * ) Notice: Subject to any disclaimer, the term of this patent is extended or adjusted under 35 U.S.C. 154(b) by 1042 days.

(21) Appl. No.: 11/995,293

(22) PCT Filed: Apr. 6, 2007

(86) PCT No.: PCT/US2007/008651
§ 371 (c)(1),
(2), (4) Date: Jul. 1, 2008

(87) PCT Pub. No.: WO2007/120583
PCT Pub. Date: Oct. 25, 2007

(65) Prior Publication Data

US 2008/0263899 A1 Oct. 30, 2008

Related U.S. Application Data

(60) Provisional application No. 60/791,955, filed on Apr. 14, 2006, provisional application No. 60/842,509, filed on Sep. 6, 2006.

(51) Int. Cl.
*A43B 7/08* (2006.01)
*A43B 7/00* (2006.01)

(52) U.S. Cl.
USPC ..... 36/3 B; 36/35 B; 36/29

(58) Field of Classification Search
USPC ..... 36/3 A, 3 B, 3 R, 35 B, 29, 147
See application file for complete search history.

(56) References Cited

U.S. PATENT DOCUMENTS

| | | | | | |
|---|---|---|---|---|---|
| 3,716,930 | A | * | 2/1973 | Brahm | 36/3 B |
| 3,973,336 | A | * | 8/1976 | Ah | 36/3 B |
| 4,222,182 | A | * | 9/1980 | Sears | 36/44 |
| 4,224,746 | A | * | 9/1980 | Kim | 36/3 B |
| 4,312,140 | A | * | 1/1982 | Reber | 36/3 B |
| 5,010,661 | A | * | 4/1991 | Chu | 36/3 B |
| 5,341,581 | A | * | 8/1994 | Huang | 36/3 B |
| 5,606,806 | A | * | 3/1997 | O'Dwyer | 36/3 B |
| 5,706,589 | A | | 1/1998 | Marc | 36/27 |
| 5,761,831 | A | * | 6/1998 | Cho | 36/28 |
| 5,845,417 | A | * | 12/1998 | Reed et al. | 36/3 B |
| 5,860,225 | A | | 1/1999 | O'Dwyer | |
| 6,044,577 | A | * | 4/2000 | Clark | 36/3 B |
| 6,079,123 | A | * | 6/2000 | Clark | 36/3 B |
| 6,430,843 | B1 | | 8/2002 | Potter et al. | |
| 6,665,957 | B2 | | 12/2003 | Levert et al. | |
| 2005/0102858 | A1 | | 5/2005 | Yen | 36/28 |

FOREIGN PATENT DOCUMENTS

| | | |
|---|---|---|
| EP | 0319968 | 6/1989 |
| FR | 2648991 | 1/1991 |
| JP | 47-28142 | 11/1972 |
| JP | 58-89201 | 5/1983 |

(Continued)

OTHER PUBLICATIONS

International Search Report and Written Opinion dated Dec. 19, 2007 issued in corresponding PCT Application No. PCT/US2007/008651.

*Primary Examiner* — Jila M Mohandesi
(74) *Attorney, Agent, or Firm* — Ostrolenk Faber LLP

(57) ABSTRACT

An article of footwear has a shoe body, including a shoe upper and a bendable sole which together define a first cavity, and the sole includes a second cavity. A pump is positioned inside the second cavity and it is operated by a device inside the sole. This device contains at least one portion movable within the second cavity against the pump in response to bending or unbending of the sole.

14 Claims, 30 Drawing Sheets

(56) References Cited

FOREIGN PATENT DOCUMENTS

| | | |
|---|---|---|
| JP | 62-8702 | 1/1987 |
| JP | 2001-112503 | 4/2001 |
| JP | 2001-258605 | 9/2001 |
| JP | 2002-178305 | 6/2002 |
| JP | Y-003121380 | 5/2006 |

* cited by examiner

ARTICLE OF FOOTWEAR

CROSS REFERENCE TO RELATED APPLICATION

The present application is a 35 U.S.C. §§371 national phase conversion of PCT/US2007/008651, filed Apr. 6, 2007, which claims priority of U.S. Provisional Application No. 60/791,955, filed Apr. 14, 2006, and U.S. Provisional Application No. 60/842,509, filed Sep. 6, 2006, the disclosure of which has been incorporated herein by reference. The PCT International Application was published in the English language.

FIELD OF THE INVENTION

The present invention is concerned with an article of footwear, and in particular an article of footwear in which the climate therein can be more effectively controlled. The present invention is also concerned with components which may be used for constructing such a footwear article.

BACKGROUND OF THE INVENTION

During the course of a day, a foot, trapped within the confines of a conventional article of footwear, has a tendency to become hot and sweaty. This can cause a number of issues including poor foot odour and fungal infections such as athlete's foot. In these situations, an article of footwear that is better ventilated can cool and help to remove moisture, thus improving the unhealthy conditions within the footwear.

The prior art contains a number of examples of ventilated footwear; both those that employ a selectively permeable membrane and those that are provided with a pump. In both cases, the conventional designs have their drawbacks.

Footwear with selectively permeable membranes are limited in their effectiveness because the same qualities that make the membrane impervious to water also limit the amount of air that can pass through them. These designs usually include a membrane that is mounted above a perforated outsole and are susceptible to blockage as mud and dirt build up on the bottom surface of the sole.

Conventional pump-ventilated footwear is characterized by a pump mounted in a cavity within the sole and comprising a resilient chamber in communication with inlet and outlet check valves. In particular, the inlet valve controls the supply of air from outside the footwear while the outlet valve controls flow into one or more ventilation passages for distributing the air through the footwear. Due to the wearer's weight, during walking the sole of the footwear tends to be downwardly pressed and this pressure acts to compress the chamber in the sole, forcing air through the outlet valve into the shoe cavity. When the footwear is raised from the ground, the chamber is restored by the inherent resilience of the pump such that is will return to its default undeformed state, drawing in another charge of air.

U.S. Pat. No. 1,660,698 describes a prior art shoe where the pump chamber is formed as a resilient bellows or bladder received in a recess in a conventional relatively rigid heel, adjacent a flexible inner sole. U.S. Pat. No. 4,601,441 provides another example of prior art but where the pump chamber is formed as a cavity directly in a resilient sole.

In conventional pump-ventilated footwear, such as the aforementioned examples, the wearer's weight is supported by an air chamber in the sole; and the amount of ventilation is largely dependent on the amount of deformation of the sole during walking. For increased ventilation, the air chamber must be made larger or be made to deflect more, and thus the vertical movement of the foot within the shoe body sole must be increased or the lateral (horizontal) size of the pump increased, or both. All of these factors disadvantageously decrease the stability of the shoe, particularly in the lateral direction. To avoid this lack of stability with this type of footwear article, the amount of deflection and the size of the chamber, and consequently the displacement of the pump, are often relatively small in designs that are commercially available. FIGS. 1*a* and 1*b* illustrate the operation of a pump mechanism in such a conventional footwear article in that a pump member of the pump mechanism operates in response to the deformation of the shoe sole. Accordingly, it has been difficult to design inexpensive and reliable footwear of this type that provides good and practical ventilation for wearers with satisfactory stability.

Another drawback associated with conventional pump-ventilated footwear articles is that they typically provide ventilation only when the wearer's body weight is forced against the heel; and not during any other part of the walking motion.

A further disadvantage of conventional ventilated footwear is that they may not be suitable for wearing in cold climates. This is because external cold air would be undesirably drawn to the shoe cavity by the pump or through the selectively permeable membrane.

The present invention seeks to address the aforementioned problems in ventilated footwear. Furthermore, the invention seeks to take advantage of the air circulation in the footwear by introducing improvements which include means to circulate warm air, a deodorant, antiperspirant and/or fragrance.

SUMMARY OF THE INVENTION

According to a first aspect of the present invention, there is provided with an article of footwear comprising a shoe body including a shoe upper and a bendable sole which together define a first cavity, wherein the sole is provided with a second cavity therein for housing at least one pump operable by means actuable thereon located inside the sole, wherein the actuation means contains at least one portion movable within the second cavity against said pump in response to bending or unbending of the sole.

Preferably, the sole may include a front portion, a mid portion and a rear portion, and may be bendable at or near said mid portion in response to or during walking motion, and wherein the actuation means may generally be of an elongate profile, and may include a front segment generally residing in the front portion, a rear segment generally residing in the rear portion and a pivotal region connecting the front segment and the rear segment, wherein the pivotal region may be arranged at or near the bendable mid-portion.

Suitably, the pump may reside between an insole and an outsole at or near the rear portion. Alternatively, the pump may reside between an insole and an outsole at or near the front portion. Further, the pump may include a front region and a rear region, and wherein the front region may be substantially thinner than the rear region. The pump may also be provided with air passageways and valves in communication with the first cavity and/or the surroundings of the footwear article. Specifically, the pump may be enclosed in a generally airtight chamber arranged in the sole and wherein the chamber may be provided with air passageways and control valves in communication with the first cavity and/or the surroundings of the footwear article.

Advantageously, the pump may be engaged with the actuation means at one end thereof. There may be provided with two said pumps, one of which is located above the one end of the actuation means and the other pump is located below the one end of the actuation means.

Preferably, the pivotal region may include a spring, a springboard or a rigid board.

Suitably, the footwear article may comprise a control valve connected to a passageway of the pump for controlling the ratio of the amount of air receivable from the first cavity and the amount of air receivable from the surroundings of the footwear article.

Advantageously, the footwear article may comprise a chamber for accommodating a temperature-regulating or substance dispensing member, wherein the chamber is connected to the first and/or second cavity. The footwear article may comprise a temperature-regulating or substance dispensing member.

Preferably, the sole may include an insole and an outsole together defining the second cavity therebetween and having a front portion and a rear portion, with the pump residing in the rear portion, and wherein the sole is made of relatively rigid material whereby in use the relative distance between the insole and the outsole at the rear portion remains essentially constant during movement of air into and/or out of the cavity.

According to a second aspect of the present invention, there is provided an article of footwear comprising a shoe body including a shoe upper and a sole which together define a first cavity and means for pumping air into and/or out of the first cavity, wherein a second cavity is defined in the sole and the second cavity is provided with a chamber divided into at least two generally airtight cells by a barrier, and each of the cells is provided with intake and outtake valves and in fluid communicable relationship with the first cavity and/or the surroundings of the footwear article, and wherein the barrier is movable towards or away from a wall within said chamber whereby on movement of said barrier at least one of the cells expands while at least the other cell collapses, simultaneously drawing in air to the expanding cell from the first cavity and/or from the surroundings of the footwear article and pumping air from the collapsing cell to the first cavity and/or the surroundings of the footwear article.

Preferably, the barrier may be in the form of a piston slidable within the chamber, causing the simultaneously expansion of one of the cells and the collapsing of the other of the cells. Alternatively, the barrier may be in the form of a bladder contained in the chamber, and wherein the two cells define one cavity in the chamber but external to the bladder, and another cavity internal to the bladder, respectively.

Suitably, the footwear article may comprise two or at least two of said bladders.

According to a third aspect of the present invention, there is provided an article of footwear comprising a shoe body including a shoe upper and a sole, wherein the shoe upper and the sole together define a first cavity, with said sole provided with a second cavity for housing pump for pumping air into and/or out of the first cavity in response to relative downward displacement of the sole, and wherein the footwear article further comprises means for amplifying action of relative downward displacement of the sole and acting on the pump, with the action amplification means provided with a pivotal or buckling region whereby in use a relatively small downward displacement action of the sole is translated into a comparatively larger displacement action on said pump.

Preferably, the sole may be provided with a relatively high heel, and wherein the pumping means may reside in the heel.

Suitably, the amplification means may have a generally elongate profile and may be generally vertically disposed on a side in the heel, and wherein in use on the relative downward displacement of the sole the action amplification means or the pivotable region bends towards and acts on the pump. In particular, the footwear article may comprise two said amplification means generally vertically disposed on opposite sides in the heel.

Advantageously, the sole may be provided with a front portion and a rear portion and the pumping means may reside at or near the front portion.

Preferably, the amplification means may comprise a torsion spring having a helical coil portion at the buckling portion Suitably, the pump may be provided with inlet and outlet valves in communication with the first cavity and/or the surroundings of the footwear article.

Advantageously, the amplification means may have an elongate profile and may be generally horizontally disposed across a length of the footwear article.

Preferably, the footwear article may comprise a control valve connected to an intake of the pump for controlling the ratio of the amount of air receivable from the surroundings of the footwear article and the amount of air receivable from the first cavity of the footwear article.

Suitably, the footwear article may comprise a chamber for accommodating a temperature-regulating or substance dispensing member, wherein the chamber may be connected to the first and/or second cavity. In particular, the footwear article may comprise a temperature-regulating or substance dispensing member.

Although three aspects of the present invention have been summarized above, the present invention can also be classified based on their characteristics, to be explained as follows.

The first characteristic "Leveraged displacement of a pump" is designed to address the stability problems found in pump-ventilated footwear in the prior art. This characteristic of the invention introduces the concept of amplifying a tiny displacement of the sole into a much more significant displacement of a pump through the use of leverage. Thus even in pump ventilated footwear actuated by weight, it can be envisaged that a small deformation of the support surface can be amplified into a large displacement of a pump thereby reducing the stability issues to a point where they are no longer a problem.

The second characteristic "Pump actuated on bending force" is different from the prior art in that the prior art covers pump-ventilated footwear actuated by the weight of a wearer against a support surface that deforms. All soles deform to some extent during walking, but the soles of conventional pump-ventilated footwear deform to a far greater extent than regular footwear as this deformation is relied on to actuate the pump.

Thus the motivation for this characteristic of the invention is to introduce features that do not require the sole to deform any more than typical footwear thus preserving the stability of the footwear.

The third characteristic "Dual-action pump" refers to a pump design that aims to maximize the efficiency of pumps of a given size. In a fixed space, there can be envisaged multiple airtight cells, each fitted with intake and outtake check valves. These airtight cells function in complementary phases such that when a first cell, or group of cells, are depressed a second cell, or group of cells, are expanded. Thus because a first cell and a second cell are never fully expanded at the same time, they can occupy the same fixed space without interfering with the function of the other. There are certain space limitations, in footwear, if the general appearance of the footwear is to be preserved, so the motivation for this characteristic of the invention is to increase the amount of airflow that can be provided by a pump mechanism of a given size.

Implementation of the above mentioned characteristics are described in the following:

Weight Actuated Mechanisms

According to this classification of embodiments, there is provided an article of footwear comprising a shoe body including a shoe upper and a sole, wherein the shoe upper and the sole together define a first cavity, wherein the sole is provided with a second cavity for housing means for pumping air into and/or out of the first cavity in response to change of pressure on the sole, and wherein the pumping means includes at least one pump member and one pivoting member having a buckling or pivotal region and is buckling or pivotal on an increased pressure on the sole whereby the pump is acted on to pump air into and/or out of the first cavity.

From an alternate perspective, this aspect of the invention can be described as follows: there is provided a ventilated footwear article, comprising a sole defining a reference portion and a moving portion, in which walking causes oscillating movement of the moving portion relative to the reference portion, a displacement-amplifying mechanism within the sole for amplifying an input displacement to produce an output displacement, the input displacement being provided by the relative movement between the moving portion and the reference portion, a pump actuated by the output displacement to supply an airflow for ventilating the footwear.

The sole between the reference portion and moving portion may be resilient or an air gap and the relative oscillating movement may be the result of compression of the sole between the wearer's foot and a support surface and expansion of the sole when the foot is raised from the support surface. The sole may be integrally formed or formed from one or more parts to provide the resiliency.

According to a first embodiment of the invention the relative oscillating movement may be the result of compression of the sole between a foot of the wearer and a support surface and expansion of the sole when the foot is raised away from the support surface and the displacement-amplifying mechanism may include a spring member having opposing ends joined by a buckling portion offset from a line joining the ends and presented toward the pump, the ends of the spring member being mounted between the reference portion and the moving portion such that the ends are substantially free to rotate, whereby movement of the moving portion with respect to the reference portion produces amplified displacement of the spring member at the buckling portion for actuating the pump. Preferably the spring member has a shallow V-shape biased towards straightening, the base of the V-shape constituting the buckling portion.

The pump preferably may comprise a bellows or bladder received in a pump cavity in the sole. The bellows preferably may have a generally oblate shape. Optionally the walls may be pleated. Preferably a pair of spring members may be mounted on either side of the bellows, each with its respective buckling portion presented towards opposing sides of the bellows such that the bellows is compressed therebetween. The spring member may comprise a torsion spring having a helical coil portion at the buckling portion. Alternatively, the spring member may comprise a springboard or another mechanism with a bias for straightening. This example encompasses designs where the spring members provide a horizontal compression of a bladder as well as an angular compression of a bladder as may be the case in a ladies high heel shoe or boot.

A second embodiment is similar to the first but utilizes a lever as the displacement-amplifying member in place of a spring or spring member. In a second embodiment—and second example of a leveraged, weight actuated mechanism—the displacement-amplifying mechanism may include one or more vertically arranged levers fixed to the reference portion, the lever having a first part for engaging the actuating face and a second part for engaging the bellows, whereby movement of the moving portion with respect to the reference portion presses the actuating face to engage the first part and pivot the lever, producing amplified displacement of the second part for actuating the pump.

In a third embodiment—and third example of a leveraged, weight actuated mechanism—there is a lever arranged along the length of an article of footwear; instead of the vertical arrangement as in the second embodiment. A tiny movement of the lever close to the fulcrum is amplified to produce a larger angular displacement at an end of the lever in order to cause amplified displacement of a pump.

The three embodiments may optionally include a temperature-regulating or substance dispensing mechanism, wherein the chamber may be in fluid-communicable relationship with the first and/or second cavity.

Weight Actuated Mechanism with Dual-Action Pump

In the first three embodiments, the pump member may be enclosed in a chamber arranged in the sole. The chamber may serve a number of functions, one of which is to protect the relatively fragile pump member therein; a second which would provide support for the foot. Further, the chamber may be fitted with intake and outtake channels and check valves; and be made otherwise airtight except through these channels. With this arrangement a "dual-action pump" is created, as air is forced out of the pump member when the pump is depressed simultaneously drawing air into the chamber; and forces out air from the chamber when the pump returns to its non-depressed state.

Bending Actuated Mechanisms

In the fourth and preferred embodiment of the invention, there is provided an article of footwear comprising a shoe body including a shoe upper and a bendable sole which together define a first cavity, wherein said sole is provided with a second cavity for housing means for pumping air into and/or out of the first cavity in response to bending or straightening of the sole. This is advantageous because this construction avoids the reliance on the deformation of a rear end of the sole in response to the change of pressure during walking in conventional pump-ventilated footwear.

Preferably, the sole may include a front portion, a mid portion and a rear portion, and may be bendable at or near the mid portion in response to or during walking. During walking, due to the anatomy of a human foot the mid-portion of the footwear article is typically being bended and the provision of a bendable portion allows the footwear to bend more easily and consistently at a similar region. It is to be understood different persons with a similar size of feet wearing the same footwear article, according to this aspect of the present invention, would bend the shoe sole in a similar extent.

During bending or straightening of the sole, the angle between the rear portion of the footwear article and the front portion changes.

Suitably, the pumping means may include at least one pump member and means actuable on the pump member for pumping air into and/or out of the first cavity. The pumping of air into and/or out of the first cavity allows ventilation of the first cavity.

Advantageously, the pump member may reside between an insole and an outsole at the rear portion although it could also be located in the front portion. The rear of the sole is a region typically taking up a relatively large space. This space may be taken advantage of in providing room for the pump member.

If the pump member is located at the rear, the actuating means is preferably fixed in the front part but relatively free to move in the back part. If the pump member is located in the fore part, the actuating means is fixed in the back part but relatively free to move in the front part.

Preferably, the pump member may include a front region and a rear region, and wherein the front region may be substantially thinner than the rear region. This configuration is advantageous for maximizing the use of space within the sole because the angular displacement caused by bending is greater at the rear region than at the front region; which is closer to the bendable mid-portion of the footwear article.

Suitably, the pump member may be enclosed in a chamber arranged in the sole. The chamber may serve a number of functions, one of which is to protect the relatively fragile pump member therein; a second which would provide support for the foot. Further, the chamber may be fitted with intake and outtake channels and check valves; and be made otherwise airtight except through these channels. With this arrangement a "dual action" pump is created, as air is forced out of the pump member when the pump is depressed simultaneously drawing air into the chamber; and forces out air from the chamber when the pump returns to its non-depressed state.

An alternative "dual action" pump could be created with two pump members placed on top of one another, in the second cavity, and divided in the middle by an actuating member such as a springboard. The top and bottom of the cavity would be formed of relatively rigid walls. For an article of footwear in its default and straightened form, the position of the actuating member would ensure that the top of the two pumps is depressed against the ceiling of the cavity. Upon bending of the footwear, the actuating member depresses the lower pump and the upper pump starts to expand. When the footwear straightens, the upper pump is depressed and the lower pump expands.

Preferably, the actuating means may be of an elongate profile, and may include a front segment generally residing in the front portion, a rear segment generally residing in the rear portion and a pivotal region connecting the front segment and the rear segment, wherein the pivotal region may be arranged at or near the bendable mid portion. In particular the pivotal region may comprise a spring or springboard. A relatively rigid board may also be used but the use of this may not be ideal as it will restrict the amount of bending.

Suitably, the actuable means may be adapted to assume a first configuration in which the actuable means is straightened or generally straight, and/or not acting on a pump member under its rear segment.

When the article of footwear first bends during walking motion the actuating means is able to stay straight but shifts positions in the second chamber depressing the pump member located under its rear segment thus assuming a second configuration. When the angular rotation of the rear segment of the sole relative to the front segment becomes so great that the pump is fully depressed, bending the shoe further would cause the actuating means to bend as well so as to not restrict the walking characteristics of the wearer thus creating a third configuration.

Suitably, the footwear article may further comprise a tube or passageway for connecting the first cavity and the second cavity and a tube or passageway for connecting the second cavity to the external environment. In particular, there may be provided with a one-way valve adapted to control the direction of movement of air between the first cavity and the second cavity in the tube and another one-way valve in the passageway to control the movement of air between the second cavity and the external environment.

As an additional feature, the embodiment might also include a temperature-regulating or substance dispensing mechanism, wherein the chamber may be in fluid-communicable relationship with the first and/or second cavity.

In a fifth embodiment—and second incorporating a bending actuating pumping mechanism—there is a pump member enclosed in a chamber beneath the bendable mid portion of an article of footwear. Bending of the shoe causes "finger-like" members to pivot and engage the pump member, the details of which will be explained in more detail herein.

Bending Actuated Mechanisms with Dual-Action Pump

In embodiments 4 and 5, the pump member may be enclosed in a chamber arranged in the sole. The chamber may serve a number of functions, one of which is to protect the relatively fragile pump member therein; a second which would provide support for the foot. Further, the chamber may be fitted with intake and outtake channels and check valves; and be made otherwise airtight except through these channels. With this arrangement a "dual action" pump is created, as air is forced out of the pump member when the pump is depressed simultaneously drawing air into the chamber; and forces out air from the chamber when the pump returns to its non-depressed state.

An alternative "dual action" pump could be created with two pump members placed on top of one another, in the second cavity, and divided in the middle by an actuating member such as a springboard. The top and bottom of the cavity would be formed of relatively rigid walls. For an article of footwear in its default and straightened form, the position of the actuating member would ensure that the top of the two pumps is depressed against the ceiling of the cavity. Upon bending of the footwear, the actuating member depresses the lower pump and the upper pump starts to expand. When the footwear straightens, the upper pump is depressed and the lower pump expands.

Additional Features

In addition to the defining characteristics of the invention, there remain a number of supplementary features that allow the invention to function more effectively and/or comfortably than the prior art.

In one aspect of the invention there is pump-ventilated footwear comprising a pump for pumping air to an outlet for ventilation of the footwear and a recirculation valve connected to an intake of the pump for controlling the ratio of air to be received from an internal inlet within the footwear, and the ratio of air to be received from an external inlet outside the footwear.

Preferably the recirculation valve is a modulating type including a housing having an aperture with a first inlet port opposite a second inlet port and an outlet port, a valve member sealingly received for linear sliding movement in the aperture, the valve member having an internal passage for connecting either or both the first and second inlet ports to the outlet port.

Additionally there are a number of different designs for various other components such as a springboard and a pump.

BRIEF DESCRIPTION OF THE DRAWINGS

Embodiments of footwear articles and their components according to the present invention will now be described, by way of examples of, and with reference to the accompanying drawings, in which.

DETAILED DESCRIPTION OF THE PRESENT INVENTION

Characteristic #1: Amplified Displacement of Pump

In this characteristic we aim to show how a large volume of air flow can be achieved while preserving the walking stability and comfort of conventional footwear.

Figure 1A:
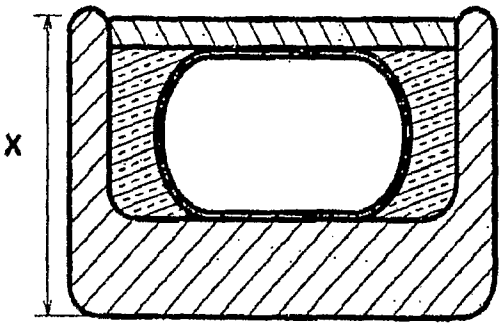
FIGS. 1*a* and 1*b* show cross section views of two shoe soles in which is shown a prior art pump-ventilated sole.
Figure 1B:
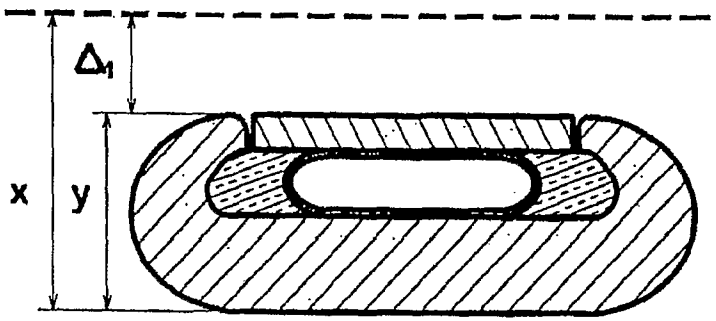

In conventional pump-ventilated footwear articles, the operation of ventilation and in particular the squeezing of the pump member is dependent to a large extent on the deformation of the shoe sole by the foot. A large pump and therefore extensive motion of compression would adversely affect the stability of the footwear. FIGS. 1*a* and 1*b* illustrate such a prior art pump-ventilated footwear sole in its expanded configuration and the same shoe sole in its compressed configuration, respectively. In the diagram it shows how the relative distance between the insole and outsole is significantly reduced during compression of the pump member (i.e., $x=y+\Delta_1$) where $\Delta_1$ is fairly large.

Figure 2A:
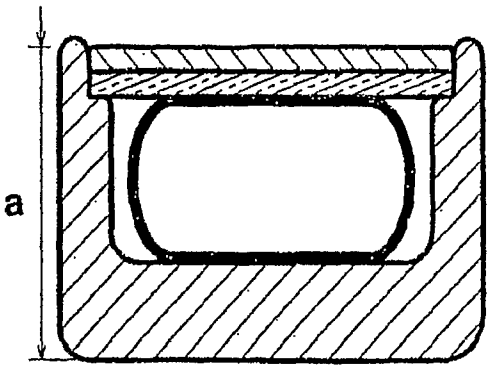
FIGS. 2*a* and 2*b* show cross section views of two shoe soles using an amplified displacement mechanism as in the current invention.
Figure 2B:
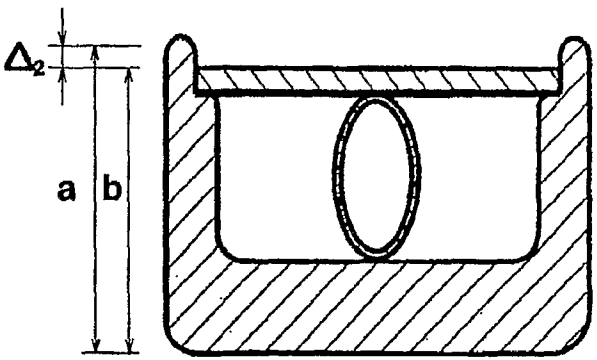

Alternatively FIGS. 2*a* and 2*b* depict a pumping mechanism in which the relative distance between an insole and outsole remain essentially constant or at least largely so $a=b+\Delta_2$) where $\Delta_2$ is fairly small and $\Delta_2 \ll \Delta_1$ for the same amount of pumping. It can be envisaged that because the shoe sole avoids significant deformation, the stability of the footwear is preserved.

The concept of amplified displacement of a pump relies on a mechanism for translating a small movement, which when applied to an amplification mechanism, is translated into a large movement to more fully actuate or compress a pump. In this manner it is believed that the problem of stability is avoided because the size of deformation of the sole is too small to pose a problem.

Figure 3:
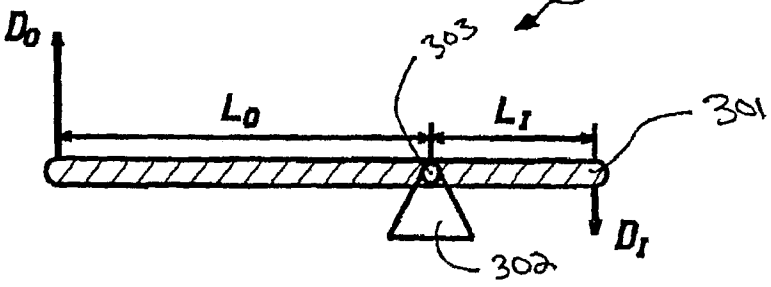
FIG. 3 shows an example of a lever system, a concept which is used in the current invention.

FIG. 3 illustrates a leveraged system 300 consisting of a lever 301 and a fulcrum 302. In the configuration, the lever 301 is divided into two lengths $L_I$ and $L_O$ divided by a pivoting point 303 at the fulcrum 302. According to the principle of leverage, the ratio between an output displacement $D_O$ and an output displacement $D_I$ is equal to the ratio between the two corresponding length $L_O$ and $L_I$ as shown in the equation $$\frac{D_O}{D_I} = \frac{L_O}{L_I}$$

which equals the amplification.

For example if $L_O=5\ L_I$ then the amplification is five fold in the displacement, or $D_O=5\ D_I$.

Figure 4:
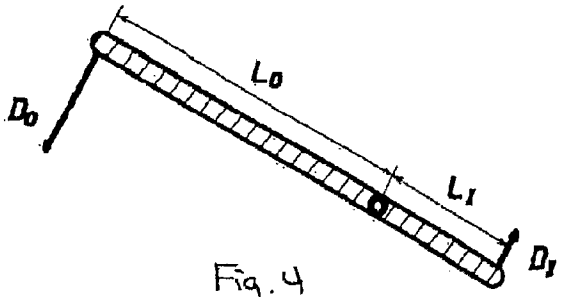
FIG. 4 shows an alternative example of a lever system and actuable means suitable for use in an embodiment of the current invention.

The concept of an amplified displacement using the principle of leverage is further illustrated in FIG. 4 in which the example shows how a small input displacement is amplified to a larger output displacement with the help of a biased fulcrum location.

Figure 5:
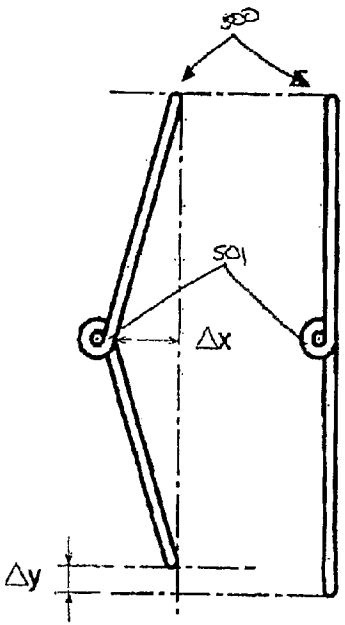
FIGS. 5 and 6 show two alternative amplifying and actuable means suitable for use an embodiment of the current invention.
Figure 6:
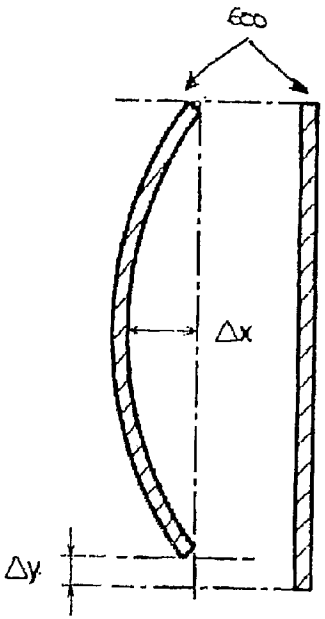

Another type of amplification mechanism is illustrated in FIGS. 5 and 6 in which the example shows how a small vertical displacement ($\Delta y$) of a spring member causes it to buckle and create a larger horizontal displacement ($\Delta x$). If placed next to a pump member, this horizontal displacement could be used to actuate it.

FIG. 5 illustrates two configurations of a spring member 500. In the configuration on the right when it is not subject to compression, the spring member 500 is in its default configuration and is generally straight. In the configuration of the left, when it is subject to compression the spring member 500 pivots at a coil portion 501 in the central region thereof, causing it to buckle. FIG. 6 illustrates two similar configurations of an alternative spring member 600. This spring member 600 is however different in that there is no distinct coil portion similar to the coil portion. Yet, the spring member 600 can generally still pivot and buckle at its central region.

Characteristic #2: Pump Actuated on Bending Force

Figure 7:
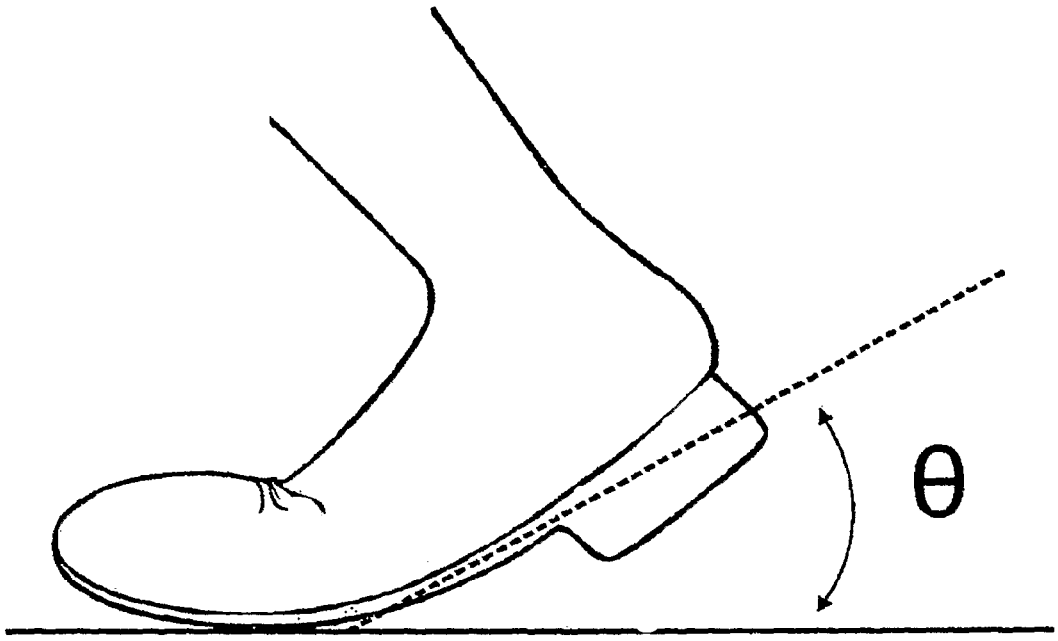
FIG. 7 illustrates the bending action of a footwear article during walking motion.
Figure 8A:
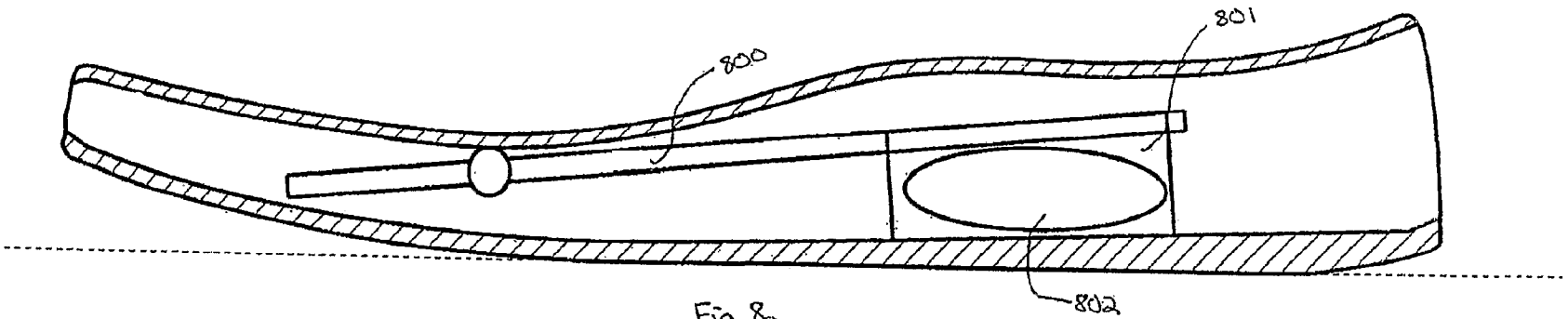
FIGS. 8*a*, 8*b*, 8*c*, and 8*d* illustrate a cross sectional view of a sole under the current invention that is actuated by bending.
Figure 8B:
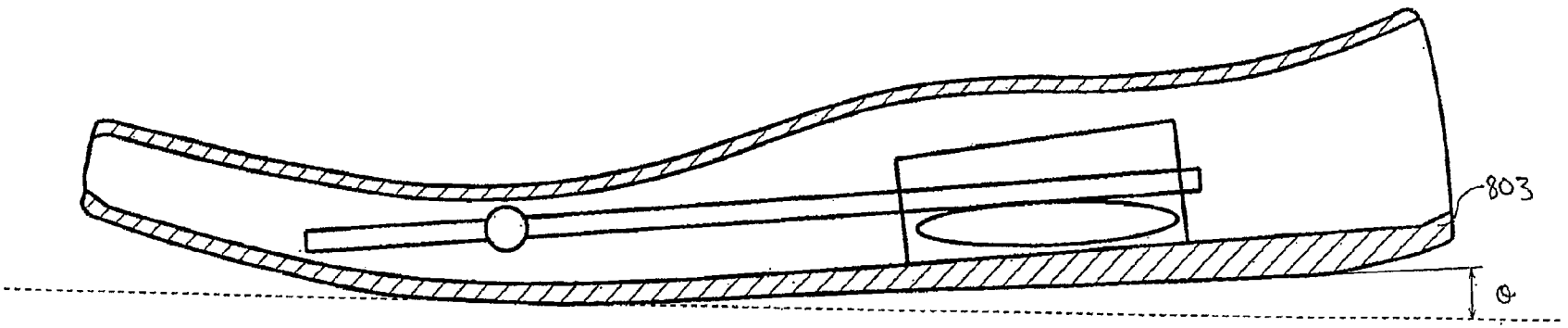
Figure 8C:
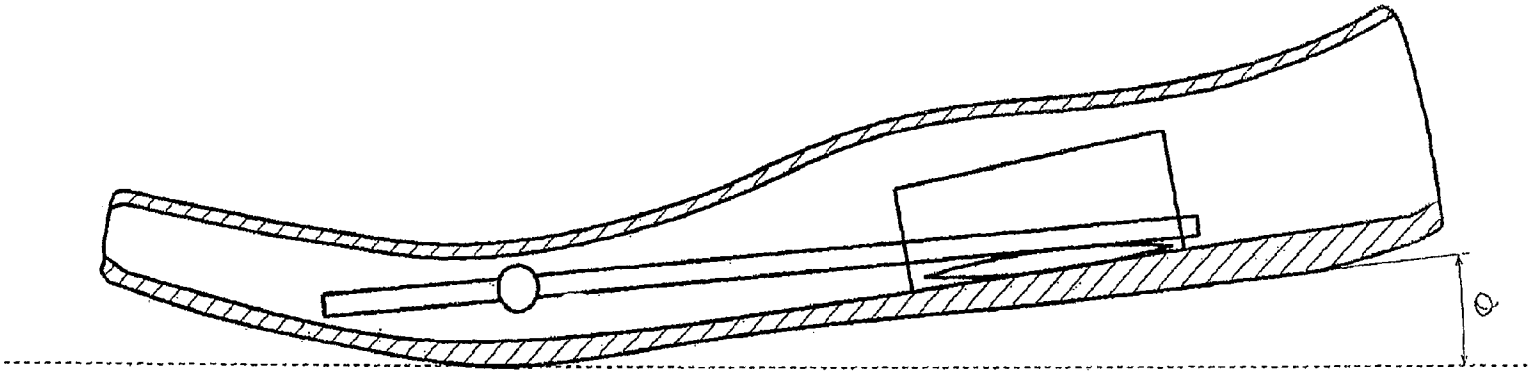
Figure 8D:
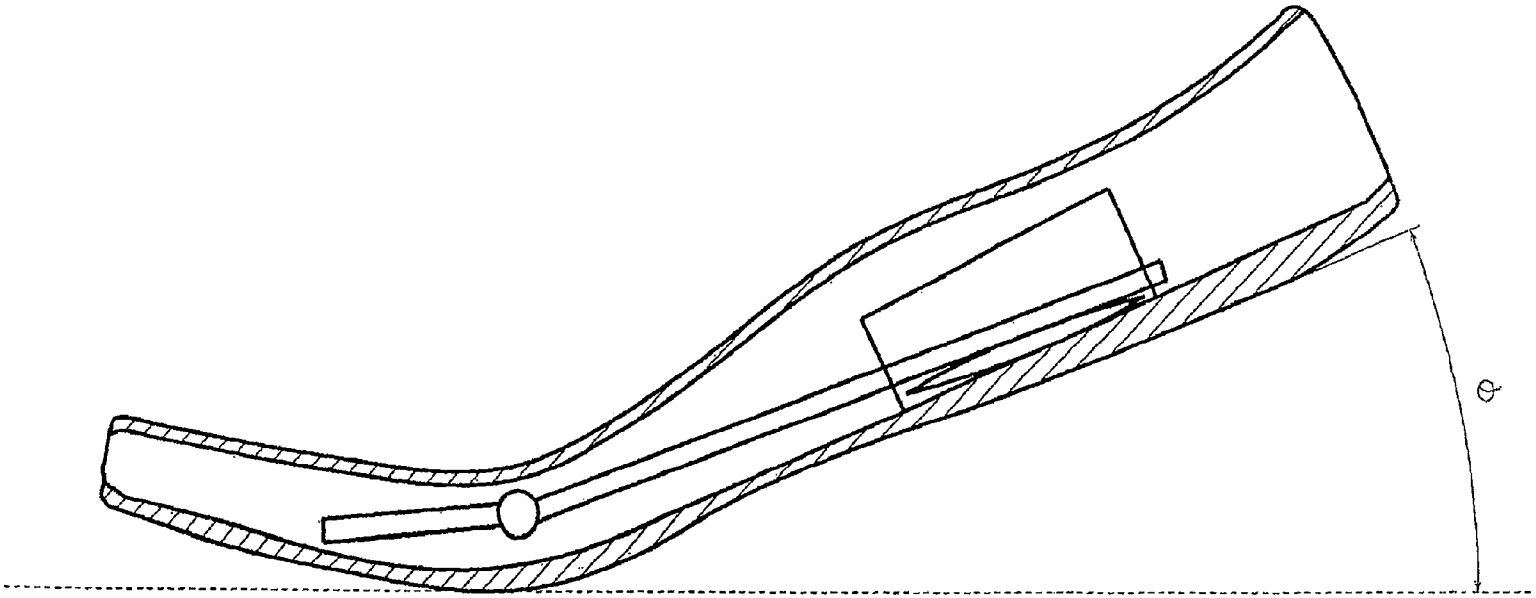

FIG. 7 illustrates the bending of a shoe body during walking motion. In typical walking motion, when a wearer's foot strikes the ground, the wearer's body weight is typically forced against the heel as the wearer's foot decelerates. The lower leg then rotates over the shoe relative to the ground, and the forefoot strikes the ground. At this point, the shoe bends as the heel is lifted from the ground (where it is straightened) in preparation for the next step. In FIG. 7, during the bending and straightening action the angle $\theta$ changes between the front part and back part of the sole. A pump or plurality of such can be actuated by the action driving the change in angle $\theta$. For the purposes of this specification, any change in the angle $\theta$, between different parts of the sole, is considered to be bending.

In pump ventilated footwear actuated by bending, there is an actuating member fixed on one end but free to move in a cavity located on its other end. A change in the angle $\theta$, caused by the bending, brings a pump member located in the cavity into a state of engagement with the actuating member so that it is depressed. That is to say, during bending of an article of footwear the free end of the actuating member changes positions in the cavity and thereby actuates a pump member located at its free end.

FIGS. 8*a*, 8*b*, 8*c*, and 8*d* illustrate the concept of a spring member 800 that is fixed in position on the left side but free to move in a cavity 801 on the other end. As the angle $\theta$ increases, caused by the raising of 803, a pump member 802 is compressed further and further by the spring member 800 until a point where the pump member 802 is fully depressed and the pump member 802 strikes the bottom of the cavity 801 and starts to bend as well. The motion of 803 in the figure is made to resemble the motion of the heel of an article of footwear during bending.

Characteristic #3: Dual-Action Pump

As previously mentioned, a "Dual-action" pump refers to a pump design that aims to maximize the efficiency of pumps of a given size. In a fixed space, there can be envisaged multiple airtight cells, each having passageways and valves in communication with the first cavity and the exterior of the footwear.

Figure 9A:
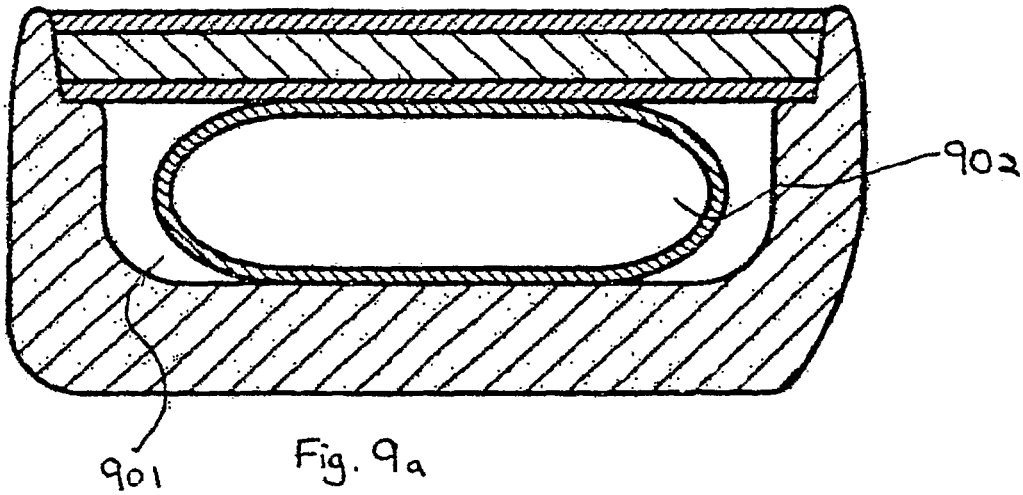
FIGS. 9*a*, 9*b*, 10*a*, 10*b*, 11*a*, 11*b*, and 11*c* illustrate cross sectional views of 3 different examples of a "dual-action pump"
Figure 9B:
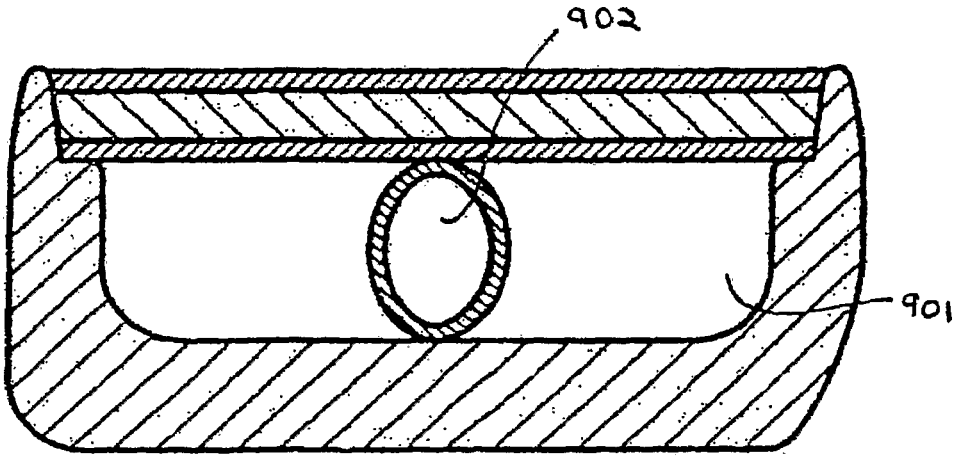

These airtight cells function in complementary states such that when a first part of cell or cells are depressed a second part of cell or cells, are expanded. FIG. 9*a* and FIG. 9*b* illustrate an example of a dual-action pump in which a bladder 902 resides in an airtight chamber 901. In this example, the bladder serves as a first part while the airtight chamber serves as a second part.

For the purposes of this specification, a cell can be considered to be an airtight enclosure having passageways and valves in communication with the first cavity and the exterior of the footwear. Therefore being cells, both the chamber and the bladder are fitted with check valves controlling the flow of air into and out of them. When the bladder or first part is depressed (i.e., pumping air out), it shrinks in size and air is sucked into the chamber or second part to fill the void left by it. As pressure is removed from the bladder or first part, the resilience of it causes it to expand against the walls of the chamber or second part pushing air out of the chamber. Thus air can be pumped into the footwear both when the first part is depressed and when the first part expands.

Figure 10A:
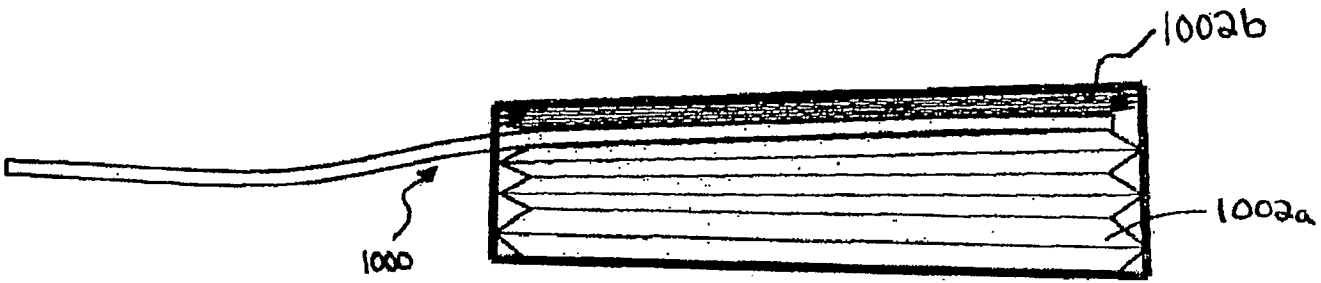
Figure 10B:
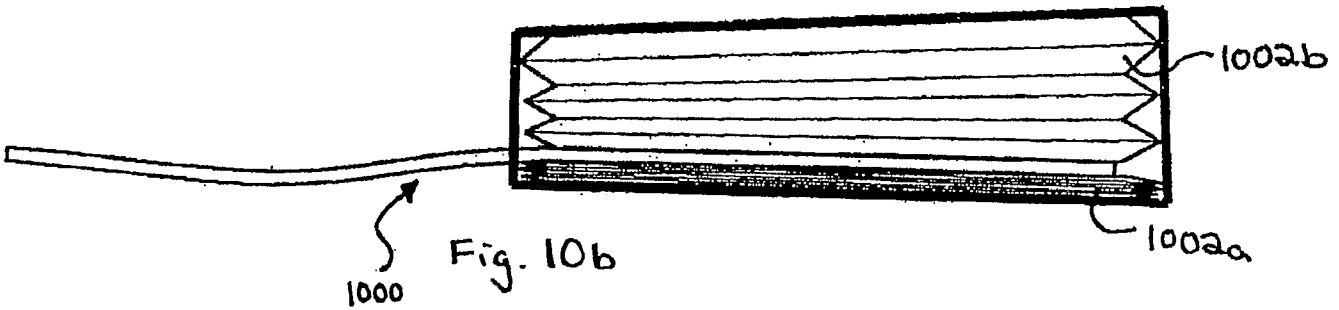

In a similar example FIGS. 10*a* and 10*b* depict a pumping mechanism where two pumps (1002*a*, 1002*b*) are confined in a relatively tight space and separated by an actuating member 1000. The two pumps represent different cells. Due to the tight confines and the resilience of the actuating member 1000, one pump member remains largely compressed and a second largely expanded in its default configuration. In the top figure, FIG. 10*a*, the top pump 1002*b* is depressed while the lower pump 1002*a* is expanded. When the actuating member 1000 presses down on the lower pump 1002*a*, the top pump 1002*b* starts to expand. Each of the two pump members (1002*a*, 1002*b*) represents a different part.

It should be noted that there can be multiple cells in a part but there must be at least one cell in each of the two parts. Each part expands and contracts in unison.

Figure 11C:
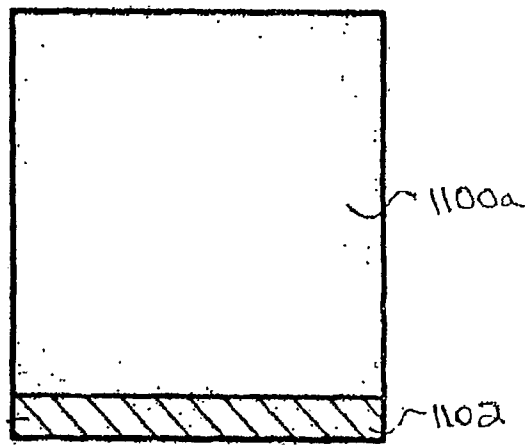
Figure 11B:
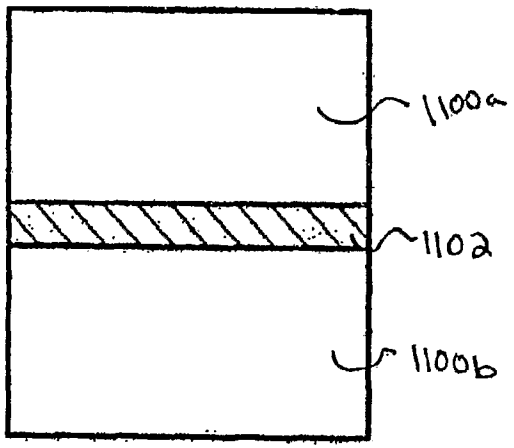
Figure 11A:
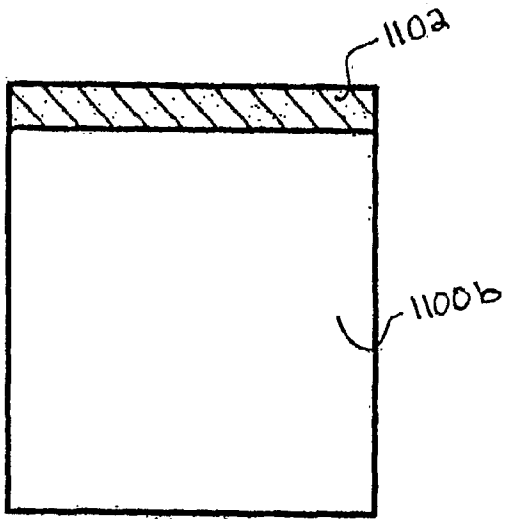

In another example, FIG. 11*a*, 11*b* and 11*c* depict a pumping mechanism that resembles a piston. The pump mechanism comprises a movable barrier 1102 within the pump member and dividing the cavity 1100*a*, 1100*b* into two airtight cells which also represent a first and a second part respectively. FIG. 11*a* shows the cavity 1100 with the lower cell 1100*b* fully expanded due to the position of the movable barrier 1102 at the top of the cavity 1100. FIG. 11*b* shows the cavity 1100 with the movable barrier 1102 positioned partway within the cavity 1100. It is to be understood that when the pump mechanism goes through the transition from a first configuration (FIG. 11*a*) to a second configuration (FIG. 11*b*), air in the lower cell 1100*b* of the cavity is compressed causing it to be pumped out of the lower cell 1100*b* of the cavity and into or out of the article of footwear depending on the direction of the valves. Simultaneously to the pumping of air out of the lower cell 1100*b* of the cavity, air flows into the upper cell 1100*a* of the cavity. If the position of the barrier 1102 were to move further down (FIG. 11*c*) it would continue to pump air out of the lower cell (1100*b*) and the upper cell (1100*a*) would continue to fill with air. If the barrier 1102 were to shift up, the reverse would happen with air being pumped out of the upper cell (1100*a*) and air sucked into the lower cell (1100*b*) of the cavity.

Embodiment 1

Figures 12A, 12B:
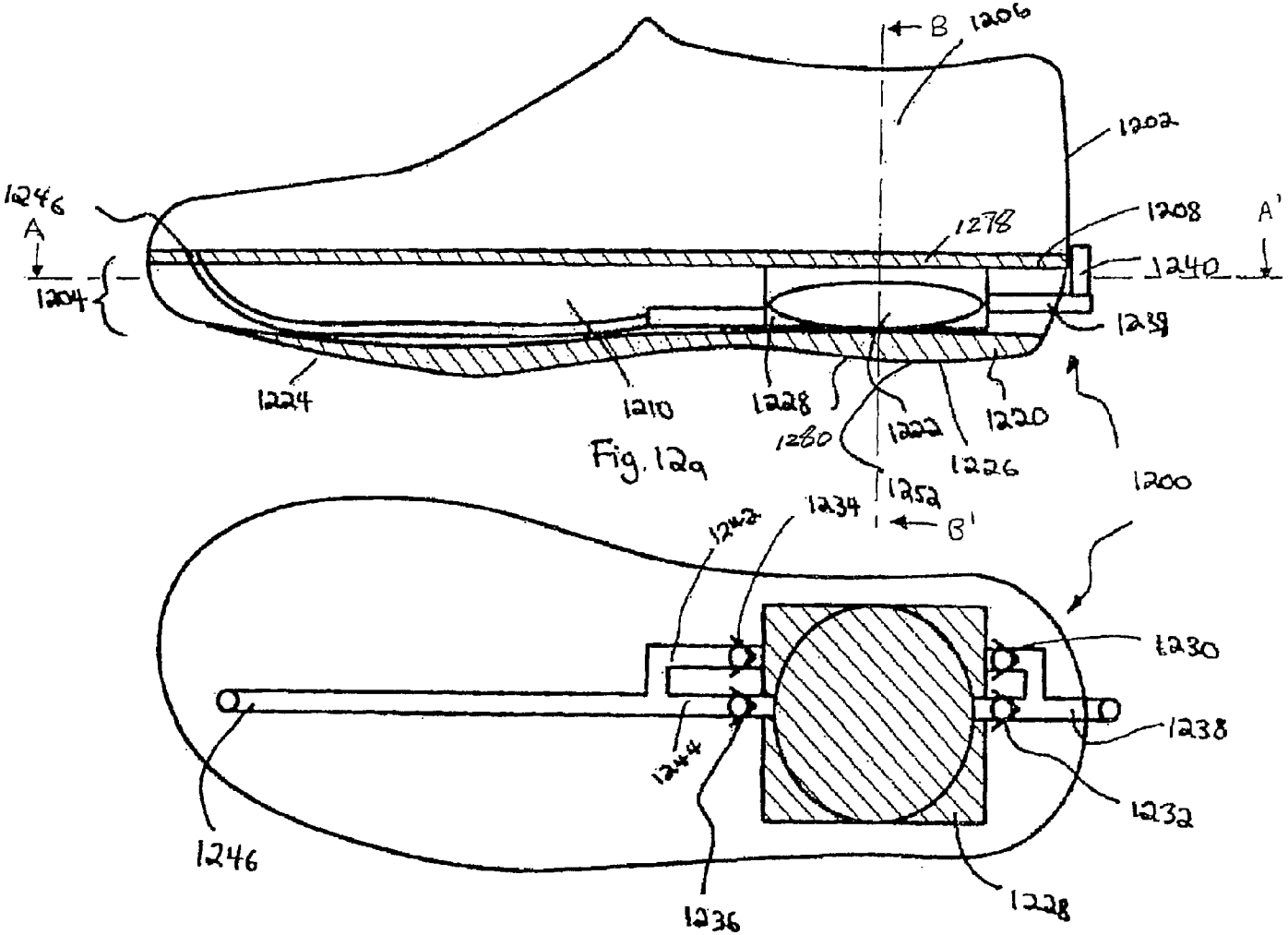
FIG. 12*a* is a schematic longitudinal section of a footwear article according to an embodiment of the present invention.
FIG. 12*b* is a schematic section along line A-A' of FIG. 12*a;*

FIGS. 12*a* and 12*b* illustrate a first embodiment of a footwear article 1200 in which a ventilated system is provided. The footwear article 1200 has a shoe upper 1202 and a sole 1204 which together define a first cavity 1206 for accommodating the foot of a wearer. The sole 1204 comprises an insole 1208, a mid sole 1210 and an outsole 1220, and a pump mechanism resides in the midsole 1210. Alternatively the mid sole 1210 can be formed as part of the outsole 1220.

The pump mechanism includes a pump member 1222 and is provided at the mid sole 1210 between the insole 1208 and the outsole 1220. In particular, the sole 1204 has a front portion 1224 and a rear portion 1226. In this embodiment, the midsole 1210 is provided with a second cavity 1228 in the form of an air-tight chamber housing the pump member 1222 at the rear portion 1226. The pump member 1222 includes inlet check valve 1232 and outlet check valve 1236 while the air-tight chamber 1228 includes inlet check valve 1230 and outlet check valve 1234. The inlet check valves 1230, 1232 are mounted in an inlet passage 1238 terminating in an opening 1240 external to the sole 1204. Outlet passages 1242, 1244 extend longitudinally from the outlet check valves 1234, 1236 and terminate in outlet opening 1246 in the front portion 1224 of the sole 1204, for ventilating the shoe cavity 1206.

Figure 13B:
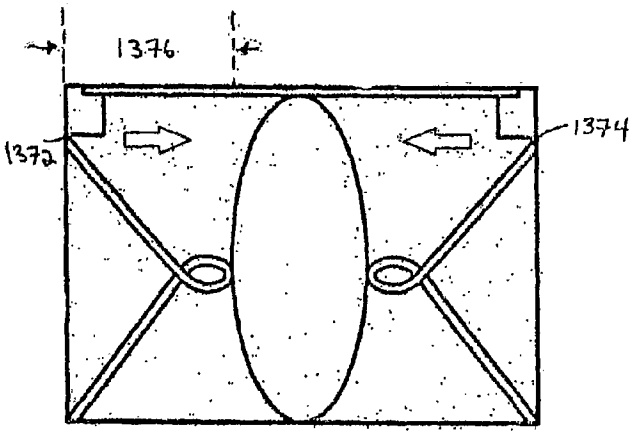
FIGS. 13*a*, 13*b*, 13*c*, 13*d* are schematic sections along line B-B' of FIG. 12*a* showing expanded and contracted configurations of a pump member, respectively.
Figure 13D:
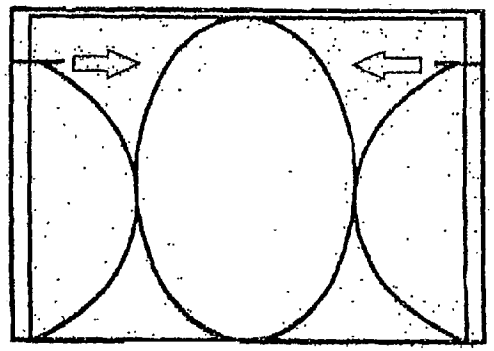
Figure 13A:
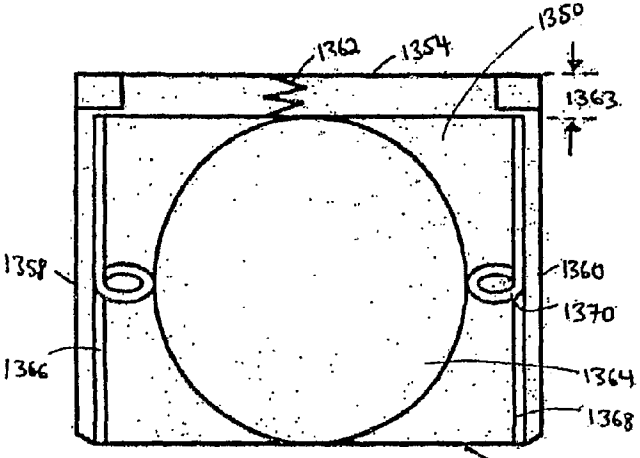
Figure 13C:
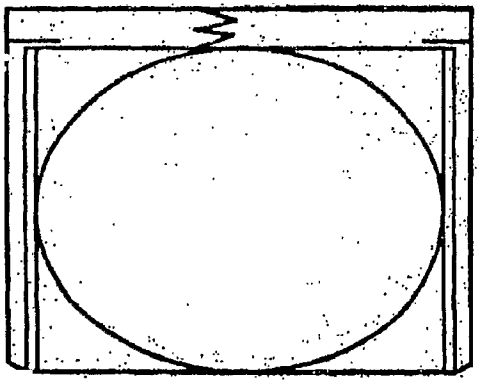

FIGS. 13*a*, 13*b*, 13*c* and 13*d* depict the pump mechanism in Embodiment 1. FIGS. 13*a* and 13*b* represent an expanded and compressed version, respectively, of a pump actuated by a torsion spring with a helical coil. FIGS. 13*c* and 13*d* represent an expanded and compressed version, respectively, of a pump actuated by a resilient springboard. FIGS. 13*a*, 13*b*, 13*c* and 13*d* illustrate a pump cavity 1350 in a heel 1252 of the footwear article 1200 bounded by an upper movable portion 1354, a lower reference portion 1356 and opposite sidewalls 1358, 1360. The pump cavity 1350 is expanded and contracted vertically as show in FIGS. 13*a*, 13*b*, 13*c* and 13*d*, the resilience of the heel 1252 being schematically represented by the spring 1362, biasing the pump cavity 1350 to its expanded position. It is understood that this resilience can be achieved in a number of ways, for instance by the appropriate selection of material (.e.g., spring, elastomer) for an integrally formed heel 1252 or by joining resilient and relatively rigid parts. The relative movement 1363 between the moving portion 1354 and the reference portion 1356, models compression of the heel 1252 and corresponding compression of the pump cavity 1350 upon heel strike. It is to be understood that the terms "reference portion" and "moving portion" are used only to differentiate two portions between which there is relative movement and are not restricted to particular portions or specific relative movements based upon the context of the described embodiment.

The pump cavity 1350 is provided with a pump member 1364 and actually operates with a displacement-amplifying mechanism including a pair of displacement amplifying spring members 1366, 1368 elongated to extend generally uprightly adjacent the side walls 1358, 1360 as show in FIG. 13*a*. Each spring member 1366, 1368 is a torsion spring having a shallow V-shape biased towards straightening or a springboard. At the base of the V-shape a helical coil portion 1370 constitutes a buckling portion which engages a side of the pump member 1364. The spring members 1366, 1368 are pivotal or bendable at the pivotal helical coil portion 1370. Lower ends of each spring member 1366, 1368 are mounted to the reference portion 1356, and upper ends to the moving portion 1354 such that they are offset from a line joining the ends of the fixed and free ends, 1372, 1374 and are free to rotate. Like buckling columns loaded in compression, the relative vertical movement 1363 between the ends of spring members 1366, 1368 is amplified as they are deflected from a shallow V-shape to a deeper V-shape, each producing an amplified output displacement 1376. FIGS. 13*c* and 13*d* depict the same mechanism with a spring member that consists of a springboard rather than a torsion spring 1366, 1368.

It can thus be envisaged that with the heel 1252 of the sole 1204 being resilient, during walking, specifically upon heel strike, the heel 1252 is compressed between the wearer's foot which abuts an inner surface 1278 and a support surface abutting an outer surface 1280. The heel 1252 expands again when the foot is raised. The oscillating expansion and contraction produced in this way is used to actuate the pump member 1364 drawing in fresh air and forcing it through the shoe for ventilation, in particular the pump member 1364 is actuated on action of the pivoting or bending of the spring members 1366, 1368. The presence of the above mentioned displacement-amplifying mechanism is advantageous because the extent of performance of the pump member 1364 depends to a large extent on a relatively small compression of the shoe sole 1204. During normal walking motion this small compression of the shoe sole 1204, means that the addition of a pump-ventilated mechanism will not affect the wearer's comfort or ankle support.

In the present embodiment, the pump cavity 1350 is an air tight chamber surrounding the pump member and is fitted with intake and outtake check valves and pipes so as to serve as a second chamber in a "dual-action" pump; the details of which were described before. Thus when the pump member 1364 is depressed, the chamber 1350 fills with air and when the pump member 1364 expands, air is pumped out of the chamber 1350.

Optionally, this design may also incorporate a temperature-regulating or substance dispensing chamber and member for circulating warm or perhaps a scented air through the first cavity 1206.

Figure 14A:
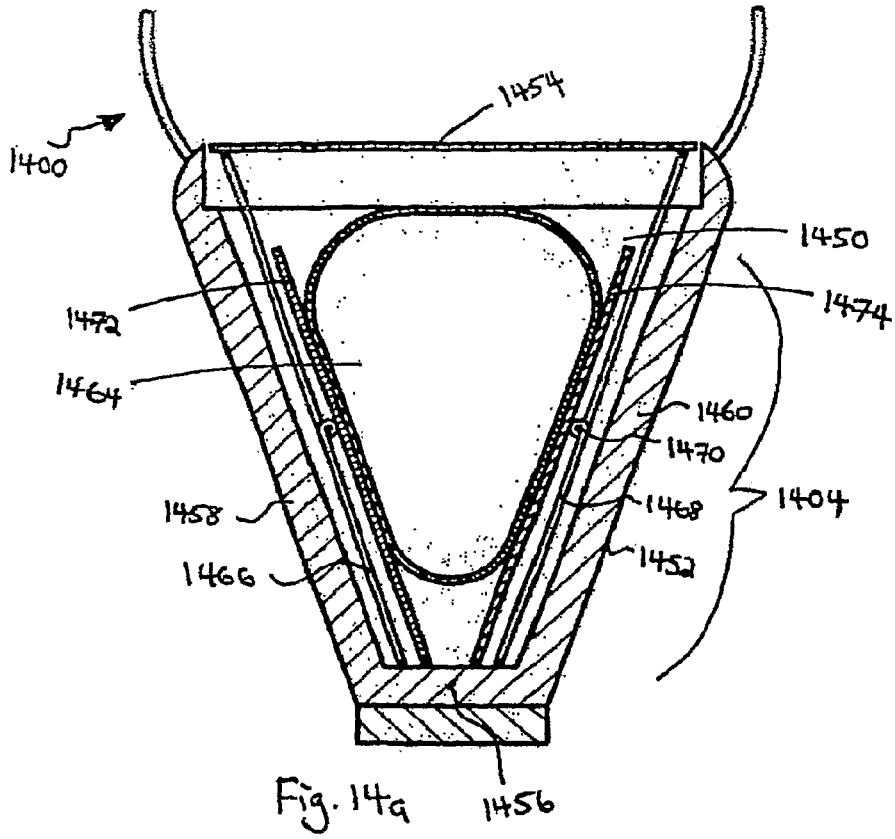
FIGS. 14*a* and 14*b* are schematic sections generally corresponding to those of FIGS. 13*a* and 13*b* but for use in a high-heeled footwear article.
Figure 14B:
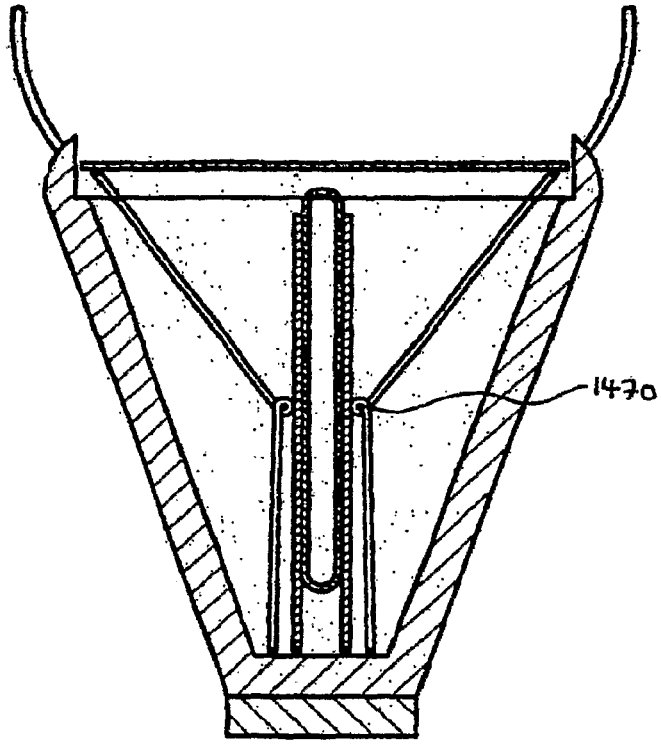

The advantages of this embodiment are particularly prominent when applied to high-heeled footwears. Most high-heeled footwears (typically referred to footwears having a heel of at least 1.5 inches) are notoriously known to be uncomfortable for a number of reasons. Providing ventilation to high-heeled footwears has also been known to be difficult because they are typically smaller and with minimal space for accommodating a ventilation device. FIGS. 14*a* and 14*b* illustrate how the first embodiment can be extended to encompass a high-heeled footwear 1400 (only cross-section of footwear around the heel is shown). From these figures, it is shown that there is a mid sole 1404 including an area between the top and the bottom of a heel 1452. A similar pump cavity 1450 enclosing a pump member 1464 similar to the pump cavity 1250 in the previous example is illustrated, although it resides within a high-heel boot or footwear bounded by an upper moving portion 1454, a lower reference portion 1456 and side walls 1458, 1460. The pump cavity 1450 is expanded and contracted vertically, as show in FIGS. 14*a* and 14*b*, respectively, the resilience of the heel 1452 being schematically represented by the spring member 1466, 1468 biasing the pump cavity 1450 to its expanded position. When the heel strikes the upper moving portion 1454, it engages the spring members 1466, 1468 causing them to buckle and press an actuating face 1472, 1474 against the pump member 1464. When the heel is raised, the resilience of the spring members 1466, 1468 causes the upper moving portion 1454 to return to its normal state.

The springs are provided with a helical coil portion 1470, which is preferred to be a buckling portion being able to perform a pivot function at a mid region thereof because it approximates a hinge thus providing a larger displacement. The sides of the V-shape are relative straight and the coil portion 1470 provides a distinct break, however this is not essential. The spring members 1466, 1468 may have a central reduced section providing the buckling portion or it may be of substantially uniform section such that a general, rather than localized bowing occurs upon compression as shown in FIGS. 13*a* and 13*b*. It is envisaged that even though the heel of a high-heeled footwear is relatively small, it can still accommodate the pump and the displacement-amplifying mechanism. It is to be noted that while in some embodiments like the above first example the spring members are vertically arranged in the sole, they may be arranged in a generally V-shaped manner, conforming to the general shape of the heel of a typical high-heeled footwear.

Embodiment 2

Figures 15A, 15B, 15C, 15D:
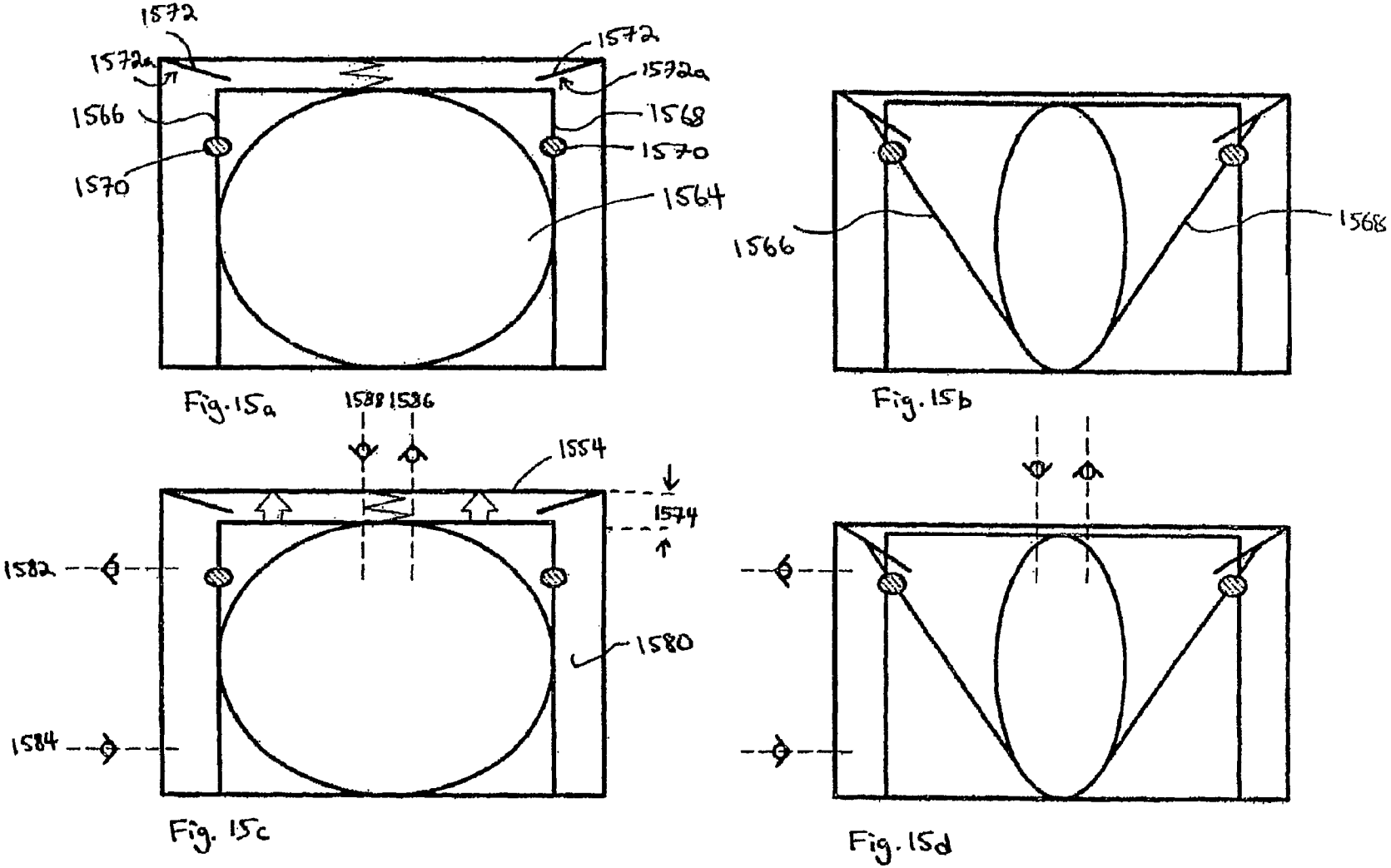
FIGS. 15*a*, 15*b*, 15*c* and 15*d* are schematic sections similar to 13*a*, 13*b*, 13*c*, 13*d* in principle although the detailed operations thereof are different.

A second embodiment of a footwear article or shoe is generally similar to the first embodiment, except this embodiment adopts an alternative displacement amplifying mechanism. The pump mechanism comprises a pump member 1564 enclosed in an air-tight chamber 1580. As shown in schematic FIG. 15*a* to FIG. 15*d*, the alternative displacement-amplifying mechanism includes a pair of displacement-amplifying levers 1566, 1568. Please note that FIGS. 15*c* and 15*d* are similar to those in FIGS. 15*a* and 15*b* except that they depict the inclusion of an inlet 1582 and outlet valve 1584 for the chamber 1580 and an inlet 1586 and outlet valve 1588 for the pump member 1564.

The levers 1566, 1568 are fixed by respective pivots 1570 towards an upper region on opposite side walls of the chamber. The chamber is enclosed in a larger chamber, and there is provided an actuating member 1572 having an actuation face 1572*a* fixedly secured on the inner upper opposite sides of the larger chamber located in the heel of the footwear article. The actuating face 1572*a* is inclined relative to and is positioned above the levers 1566, 1568. When the sole positioned above the heel is not subject to pressure, there is a certain clearance 1574 between the actuating face 1572*a* and the levers 1566, 1568 (See FIG. 15*c*). Although when the sole is subject to pressure the actuating member 1572 is pushed downwardly causing the levers 1566, 1568 to pivot towards the pump member 1564, causing it to collapse (see FIGS. 15*b* and 15*d*). The location at which the actuating member 1572 is attached is a movable portion 1554 which represents a downward moving portion of an insole of the shoe in a foot strike. With the heel in its expanded state, the levers 1566, 1568 lie generally parallel to the sidewalls of the heel or chamber. Upon compression, the actuating face 1572*a* engages the upper ends of the lever 1566, 1568 when the moving portion 1554 is displaced, thus rotating a second part or lower end thereof, causing it to engage the pump member 1564, as shown in FIGS. 15*b*, 15*d*.

As depicted, the pump member 1564 can enclosed in an airtight chamber 1580 fitted with intake 1582 and outtake 1584 check valves and pipes so as to serve as a second part of cell or cells in a "dual-action" pump; the details of which were described before. Thus when the pump member 1564 is depressed, the chamber 1580 fills with air and when the pump member 1564 expands, air is pumped out of the chamber 1580 and into the footwear cavity.

Optionally, this design may also incorporate a temperature-regulating or substance dispensing chamber and member for circulating warm or perhaps a scented air through the footwear cavity.

Embodiment 3

Figure 16A:
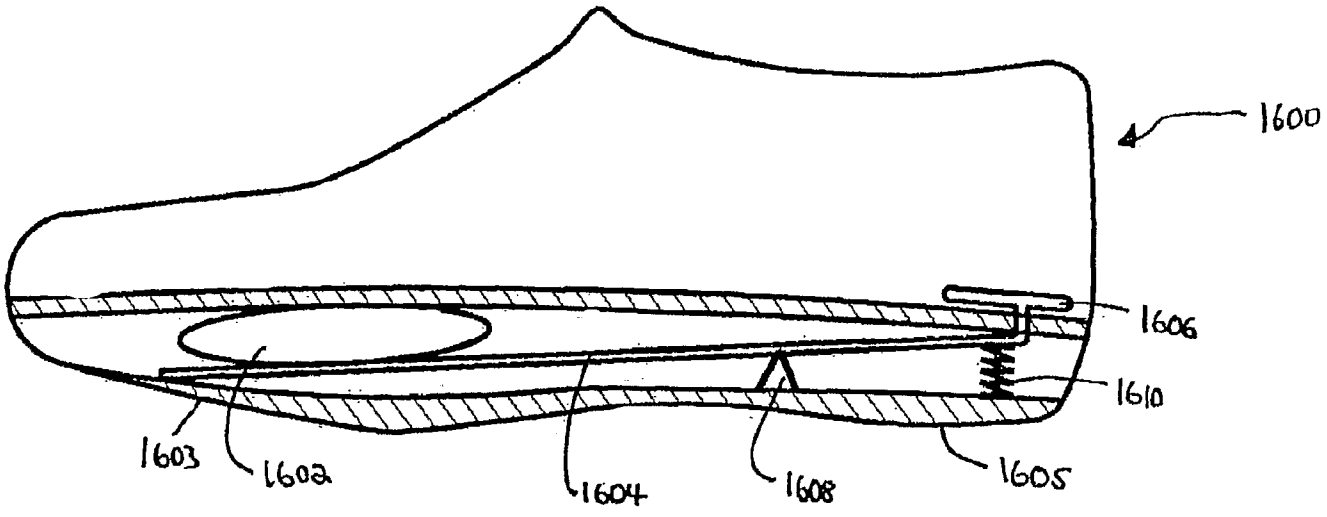
FIGS. 16*a* and 16*b* show schematic longitudinal sections of a footwear article according to an embodiment of the present invention.
Figure 16B:
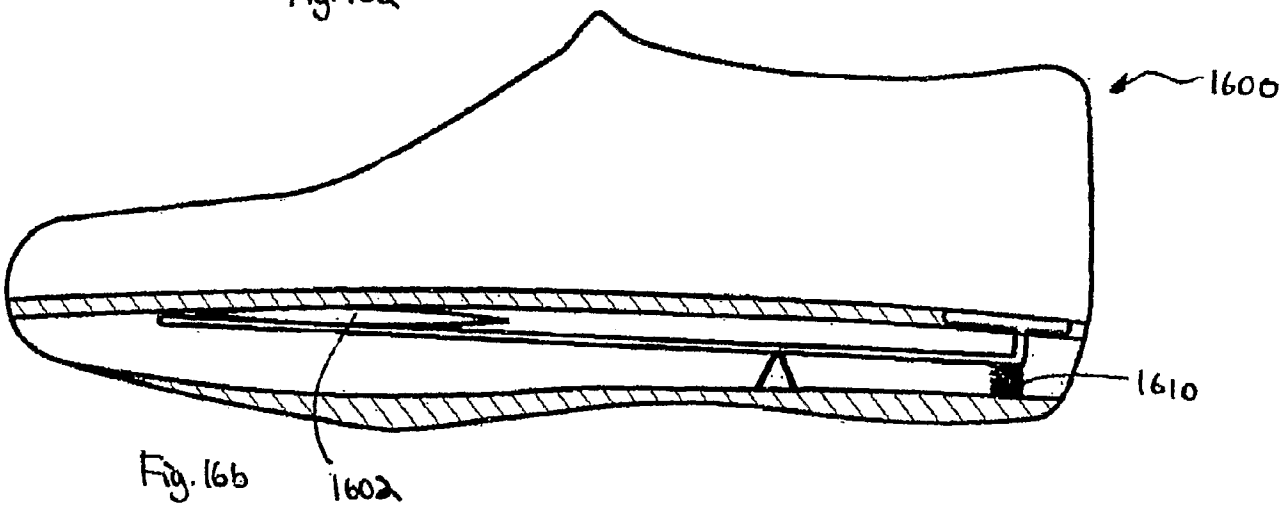

FIGS. 16*a* and 16*b* depict a third embodiment of a footwear article 1600 which utilizes the concept of a weight-based amplified displacement mechanism. As shown in 16*a*, there is a footwear article 1600 with a bladder 1602 residing in the mid part or front part 1603 on top of a lever 1604. At the back part 1605 of the footwear, and close to the fulcrum 1608, there is an interface 1606 that when pressed downward causes the lever 1604 to pivot and results in an amplified displacement for actuating a bladder 1602 located at an end of the lever 1604 far from the fulcrum 1608. In this example, the resilience of the lever 1604 is provided by a spring 1610.

Figures 17A, 17B, 17C, 17D, 17E:
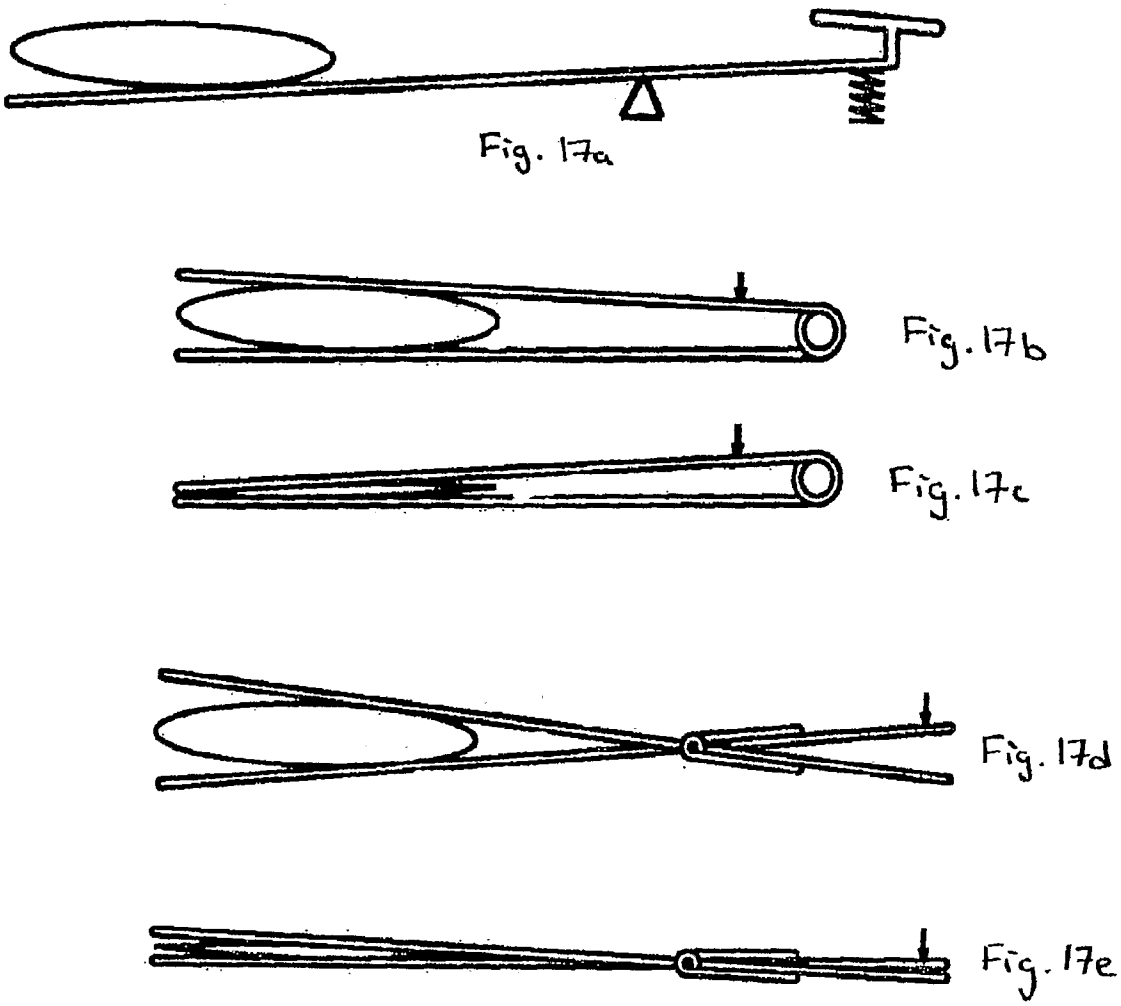
FIGS. 17*a*, 17*b*, 17*c*, 17*d* and 17*e* illustrate examples of lever mechanisms suitable for use in 16*a* and 16*b;*

In FIG. 17, we show various examples of lever systems that can be used for the implementation of a third embodiment.

17*a* depicts the lever mechanism in use in FIGS. 16*a* and 16*b*.

17*b* and 17*c* depict a second lever mechanism that resembles a set of tweezers. When force is applied to a point close to the joining section of a top and bottom of the mechanism, it causes a downward angular motion of the top portion of the lever so that a bladder is compressed between.

17*d* and 17*e* depict a third lever mechanism that resembles a pair of scissors. When force is applied to the shorter ends, it causes the actuating members to come together at the longer ends and compressing a bladder between them.

Figure 18:
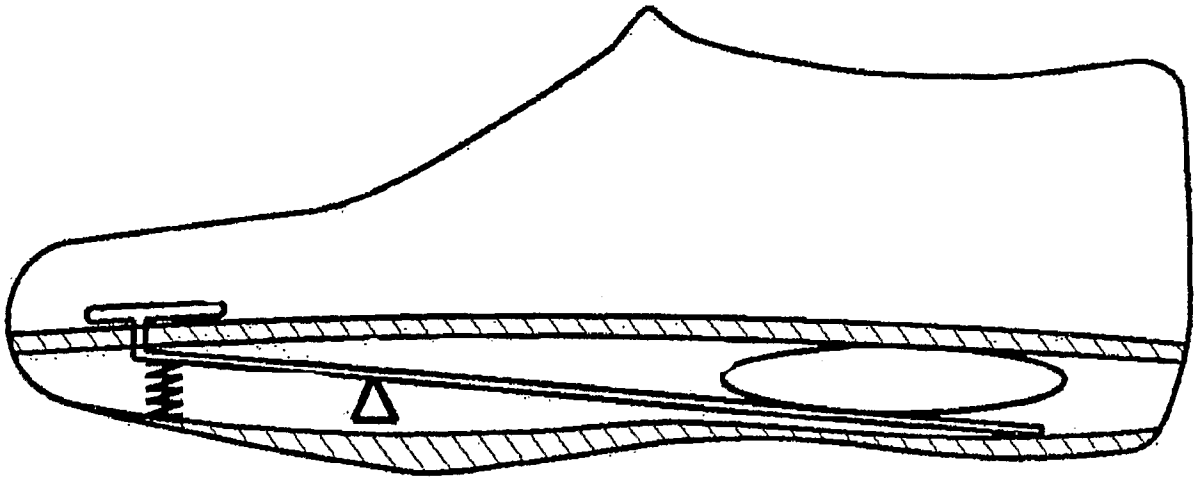
FIG. 18 show schematic longitudinal sections of a footwear article that generally corresponds to FIG. 16*a* but where the location of the mechanism is changed.

FIG. 18 depicts a footwear article similar to that in FIGS. 16*a* and 16*b* except where the interface is in the front and a bladder is compressed in the rear.

Embodiment 4

A fourth embodiment of a footwear article 1900—as shown in FIGS. 19*a*, 19*b*, 19*c* and 20—operates based on the bending and straightening of a footwear body during walking motion. The footwear article 1900 comprises a footwear upper 1902 and a footwear sole 1904 which together define a first cavity 1906 for accommodating the foot of a user. The footwear sole 1904 includes an insole 1908 and an outsole 1910 and a second cavity 1912 is located between the insole 1908 and the outsole 1910. The footwear sole 1904 includes a front portion or a forepart 1914, a mid portion and a rear portion or a heel region 1916. The sole 1904 is particularly bendable at or near the mid portion such that during walking the natural movement of the foot causes the footwear sole 1904 to bend at the bendable region (or relative rotation between the front portion 1914 and the rear portion 1916). The footwear article 1900 further comprises a mechanism for effecting ventilation or circulation of air through the first cavity 1906. The mechanism includes a pump member 1918 generally in the form of a bladder or bellows and enclosed in a chamber. A tube 1928 serving as a passageway between the exterior of the footwear and the pump is provided. Furthermore a tube 1930 serving as a passageway between the pump and the footwear interior (first cavity 1906) is provided. Valves (1932, 1934, 1936, 1938) are provided at the passageways in order to control the direction of movement of air through the tubes. The embodiment includes an actuation mechanism 1920 for controlling the operation of the pump member 1918 and hence the ventilation of the footwear article 1900.

Figure 20:
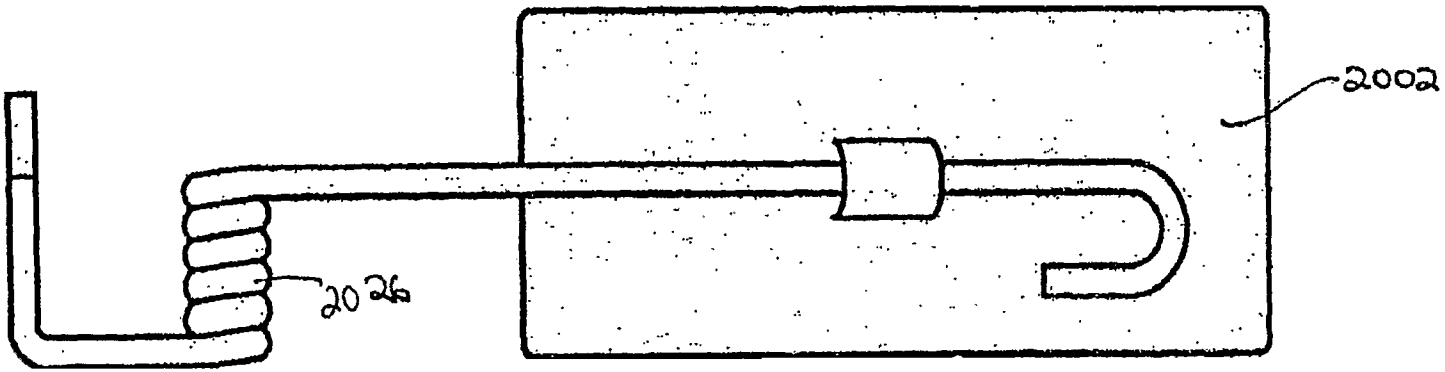
FIG. 20 shows an actuation mechanism suitable for use in FIG. 19*a;*

As shown in FIG. 20, the actuation mechanism 1920 is generally elongate in shape and resides in the mid sole. In this embodiment it is fixed in the fore part but the back end is free to move from position to position in the second cavity in response to bending or unbending of the sole. The actuation mechanism 1920 is provided with a pivotable or bending portion 1922 located at the bendable region 1924 of the footwear sole 1904. On bending of the footwear sole 1904, the actuation mechanism 1920, because of its bias to straightening, tries to maintain its default form. However, when the bending angle θ (as depicted in FIG. 7) becomes too great, the actuation mechanism 1920 is also caused to bend at the pivotable portion 1922. The pivotable portion 1922 is generally in the form of a torsion spring 2026 having a central helical portion and opposing elongate legs or ends extending either side thereof being biased in generally parallel alignment. The rear end of the actuation mechanism 1920 is received in a second cavity and is particularly arranged above the pump member 1918, facilitating the exertion of a downward force and compression on the pump member 1918 when the footwear sole 1904 is bent. To ensure that the actuating mechanism 1920 is effective in depressing the pump member, an actuating face 2002 is attached to the spring as shown in FIG. 20.

Figure 19A:
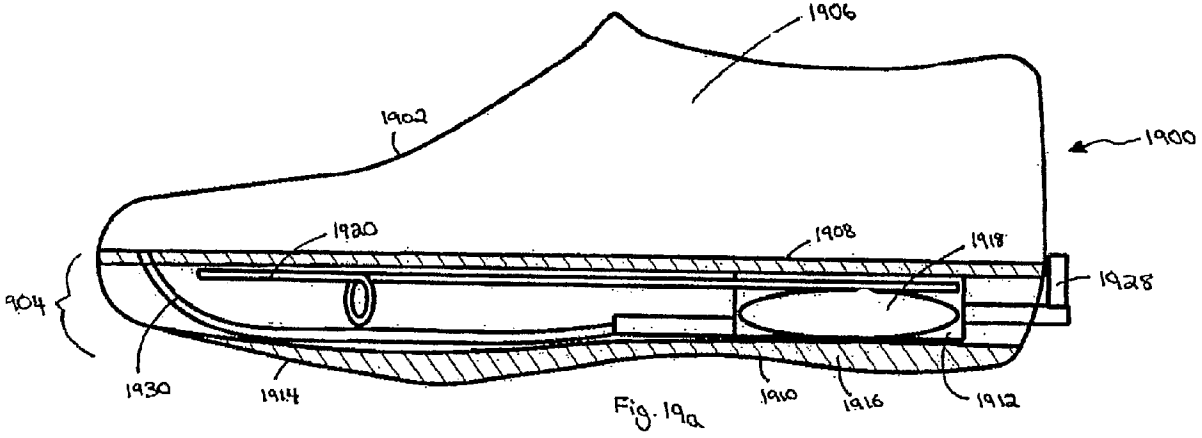
FIG. 19*a* is a schematic longitudinal section of a footwear article in a first configuration according to another embodiment of the present invention.
Figure 19B:
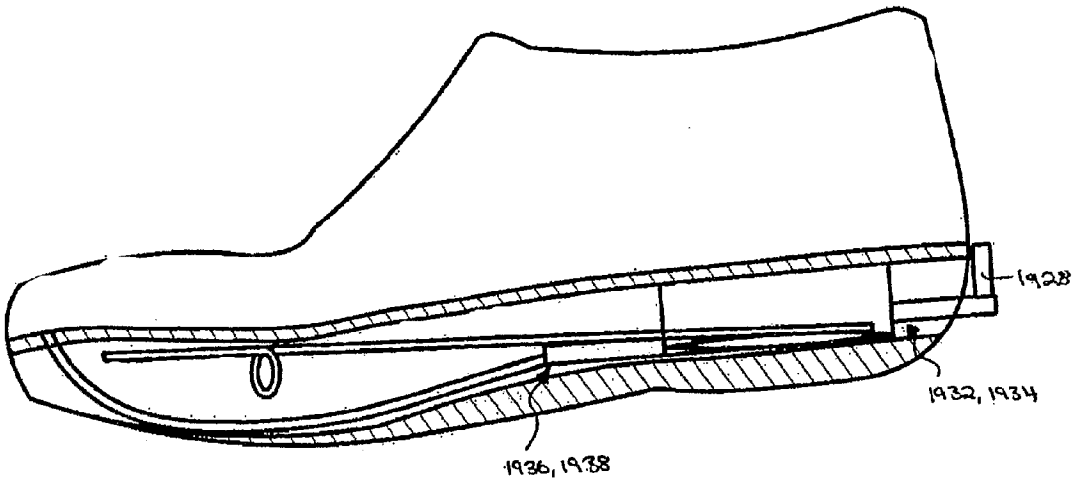
FIG. 19*b* is a schematic longitudinal section of the footwear article of FIG. 19*a* when the footwear article is in a partially bended configuration.
Figure 19C:
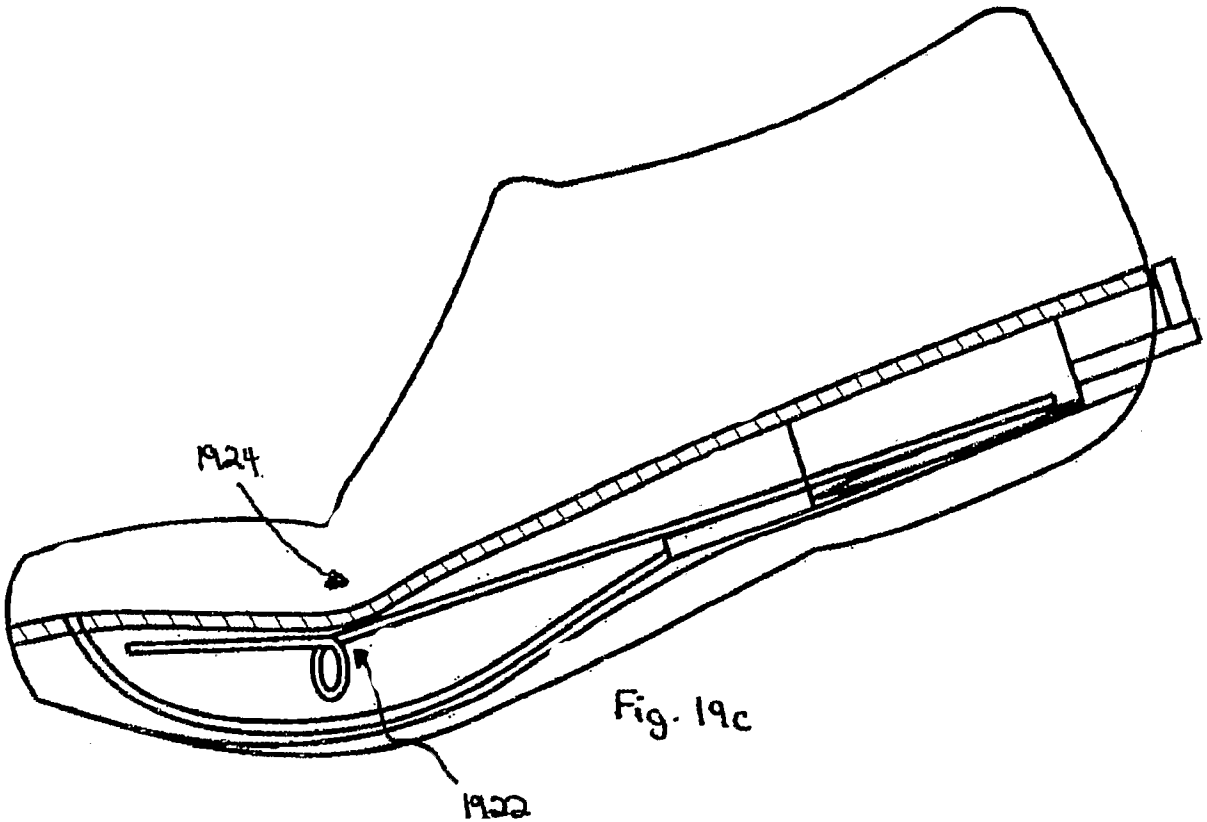
FIG. 19*c* is a schematic longitudinal section of the footwear article of FIG. 19*a* when the footwear article is in a substantially rotated or bended configuration.

FIG. 19*a* shows the sole when both the front portion 1914 and the rear portion 1916 of the footwear article 1900 are both in contact with the ground; the pump member 1918 laying between the rear end of the actuation mechanism 1920 and the floor of the chamber. During walking, when the rear portion of the footwear article 1900 is lifted and the rear portion 1916 of the footwear sole 1904 rotates relative to the front portion, due to the resilience of the pivotable portion 1922, bending of the footwear sole 1904 causes the actuation mechanism 1920 to exert a downward force depressing the pump member 1918. FIG. 19*b* shows a diagram of the footwear in a partially rotated position, whereas the rotation is significant enough to drive the rear portion (or free end) of the actuation mechanism (pivotable member) 1920 against the pump member 1918 but the amount of rotation is not significant enough to cause a significant bending in the actuation mechanism 1920. FIG. 19*c* illustrates a configuration in which the actuation mechanism 1920 is rotated or bended at the pivotal portion 1922 in response to the footwear being bended further. The inclusion of a pivotable member as the actuation mechanism 1920 is to ensure that there is not restriction on the normal walking movement of a wearer. It is to be noted that although the spring 2026 can be used for performing the pivoting function of the pivotal region, it is not necessary. Any appropriate device which can provide this pivotable or bendable function, such as a springboard would work equally well. Even a rigid board would work, however the use of this may restrict the normal bending motion during walking. After bending when the sole 1904 is again straightened the resilience of the pivotal member restores the actuation mechanism 1920 to a straightened manner, and thus also restoring the pump member 1904 to its expanded configuration as shown in FIG. 19*a*. In summary, bending causes the compression of the pump member 1918 providing an outflow of air via the tube 1930 to the first cavity 1906 for ventilating the footwear article.

Preferably the second cavity 1912 enclosing the pump member 1918 is an airtight chamber provided with intake and outtake pipes and check valves (1934, 1938). Thus when the pump is depressed there is also an inflow of air to fill the chamber surrounding the pump. When the bending of the footwear article 1900 concludes, the actuating mechanism 1920 straightens restoring the pump member 1918 to its expanded state, causing air to be pumped out of the chamber to ventilate the footwear article similar to the "dual-action" pump described in previous sections.

Optionally, this design may also incorporate a temperature-regulating or substance dispensing chamber and member for circulating warm or perhaps a scented air through the footwear cavity.

It should be noted that this embodiment does not involve the compression or deformation of the rear end of the footwear sole to function thus preserving the stability of the footwear.

Figure 21:
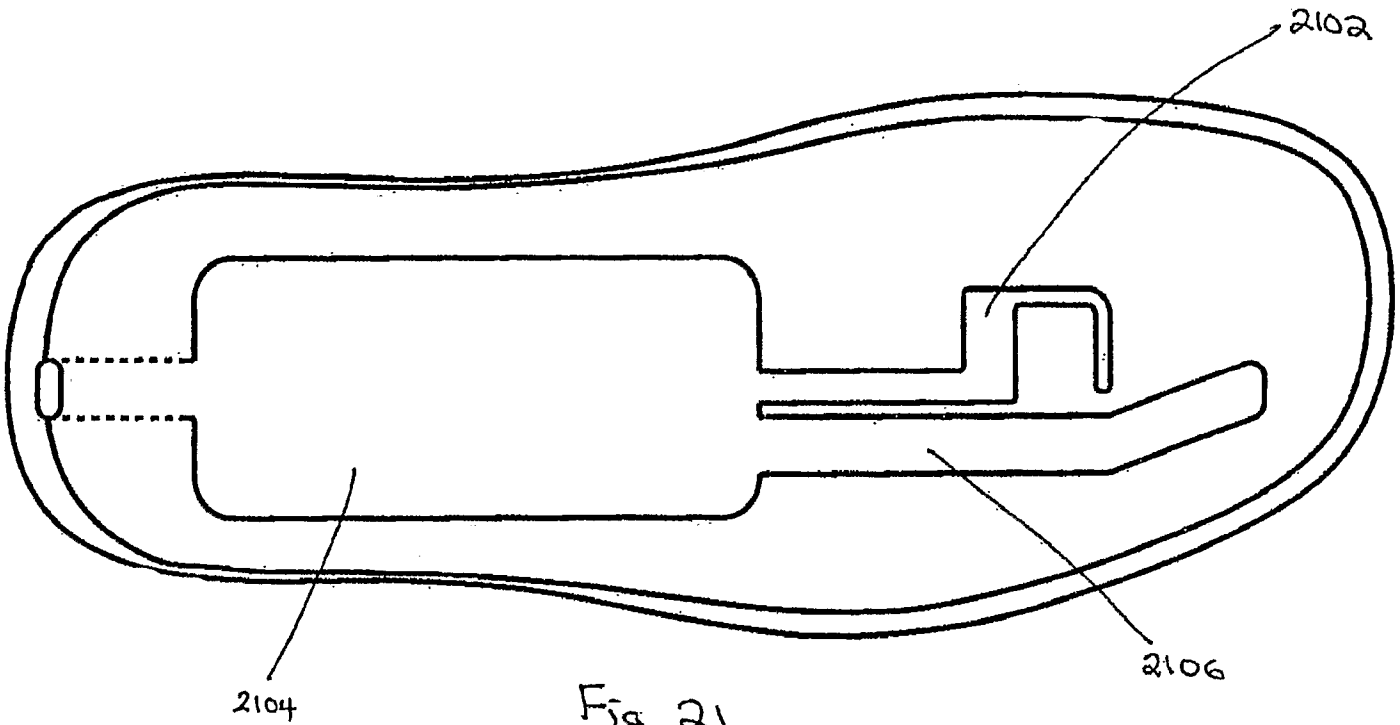
FIG. 21 shows a schematic view of a footwear sole that is suitable for use in FIG. 19*a;*

FIG. 21 shows a design for a sole incorporating the fourth embodiment wherein there is a slot 2102 to fix a spring member, a cavity 2104 to fix a pumping mechanism and a passageway 2106 to channel the air out of the pump or to otherwise fix a tube.

Figure 22:
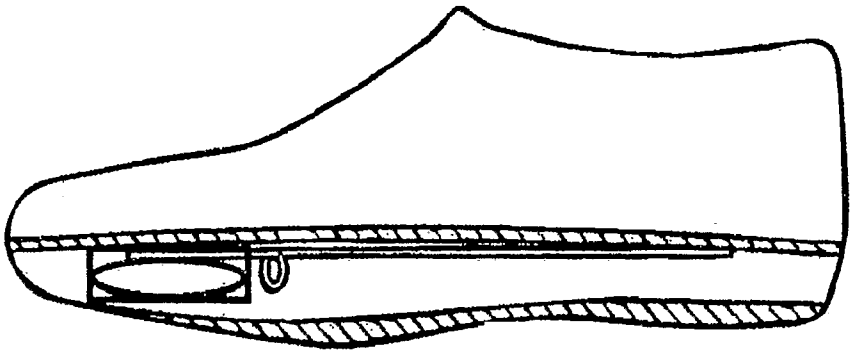
FIG. 22 shows a schematic longitudinal section of a footwear article generally corresponding to FIG. 19*a* but where the locations of the mechanisms are changed.

FIG. 22 depicts a similar footwear article to that in FIGS. 19*a*, 19*b* and 19*c* except where the pump member and cavity are now located in the front portion of the footwear and the actuating mechanism is fixed in the rear portion.

Embodiment 5

FIGS. 23*a* to 27 illustrate a fifth embodiment of a footwear article 2300 according to the present invention. The footwear article 2300 similarly comprises a shoe upper 2302 and a shoe sole 2304 which together define a first cavity. The shoe sole 2304 includes an insole 2306, a mid sole 2308 and an outsole 2310. The footwear article 2300 also comprises a mechanism primarily housed in the mid sole 2308 for effecting ventilation or circulation of air through the first cavity. The ventilation mechanism comprises a pump member 2312 enclosed in an airtight chamber 2314, which is located at a bendable region of the shoe sole 2304. Preferably, there is a passageway between the pump member 2312 and the shoe cavity and a passageway between the airtight chamber 2314 and the shoe cavity. Similarly, there is a passageway between the exterior and the pump member 2312 and a passageway between the exterior and the airtight chamber 2314. Valves are provided at the channels in order to control the direction of movement through the passageways.

Figure 23A:
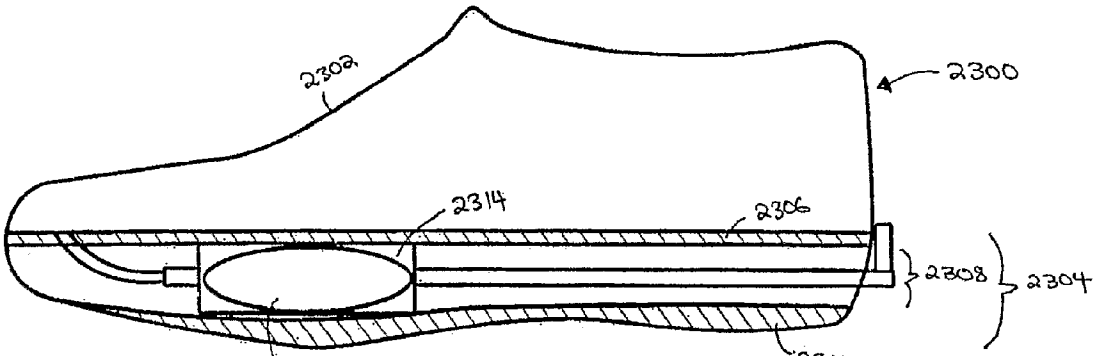
FIG. 23*a* is a schematic longitudinal section of a footwear article in a first configuration according to another embodiment of the present invention.
Figure 23B:
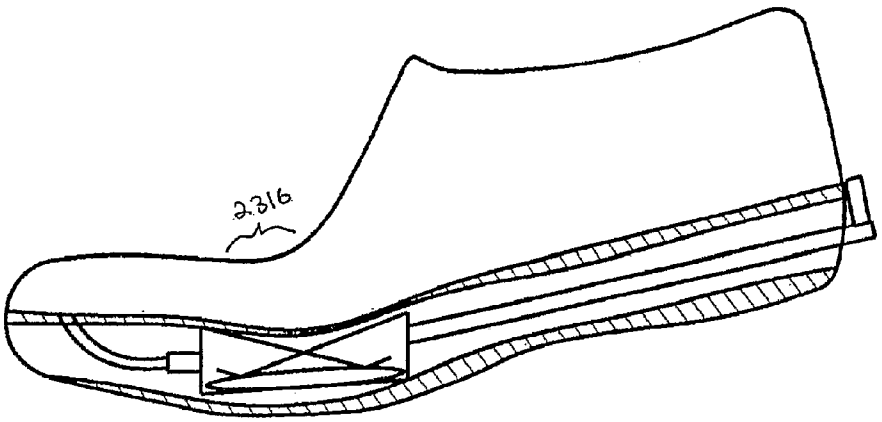
FIG. 23*b* is a schematic longitudinal section of the footwear article of FIG. 23*a* when the footwear article is bended.

The chamber 2314 containing the pump member 2312 is located at a bendable region 2316 in the mid sole 2308. The chamber 2314 is provided with a resilient ceiling wall 2520 which is deformable when subjected to pressure, as best shown in simplified FIGS. 25*a* and 25*b*. The actuation means includes a number of rib members. Only one end of each of the rib members 2422 is fixedly secured at a region to the ceiling 2520 while the opposite end (or the free end) thereof is movable or pivotable away from the ceiling wall 2520 on deformation thereof, as shown in FIG. 23*b*. Since the cavity defined by the chamber is occupied by the pump member 2312, on deformation of the ceiling wall 2520 the free ends of the rib members 2422 presses onto the pump member 2312, thus pumping air into the cavity. In particular, the rib members 2422 basically pivots at or near at the attachment region.

The pump member 2312 is preferably enclosed in an airtight chamber 2314 provided with intake and outtake pipes and check valves, so that when the pump member 2312 to ventilate the first cavity the chamber 2314 sucks in air from the outside. When the bending of the footwear article concludes, the rib members return to their default form restoring the pump member 2312 to its expanded state, causing air to be pumped out of the chamber to ventilate the footwear article similar to the "dual-action" pump described in previous sections.

Optionally, this design may also incorporate a temperature-regulating or substance dispensing chamber and member for circulating warm or perhaps a scented air through the shoe cavity.

Figure 24:
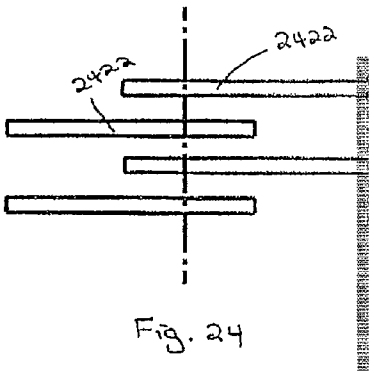
FIG. 24 shows a displacement mechanism used in FIG. 23*a;*
Figure 25A:
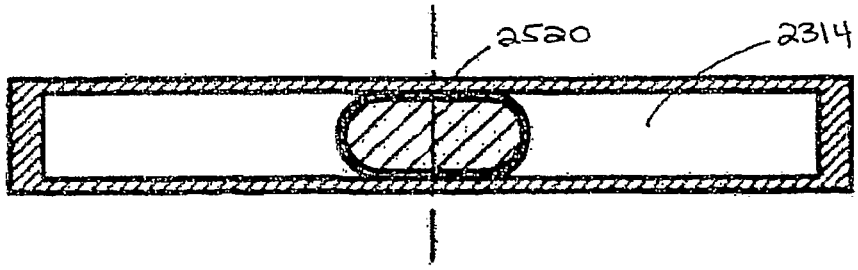
FIGS. 25*a* and 25*b* illustrates the general deformation of a chamber and bladder under the mid-portion of a footwear article similar to that in FIG. 23*a;*
Figure 25B:
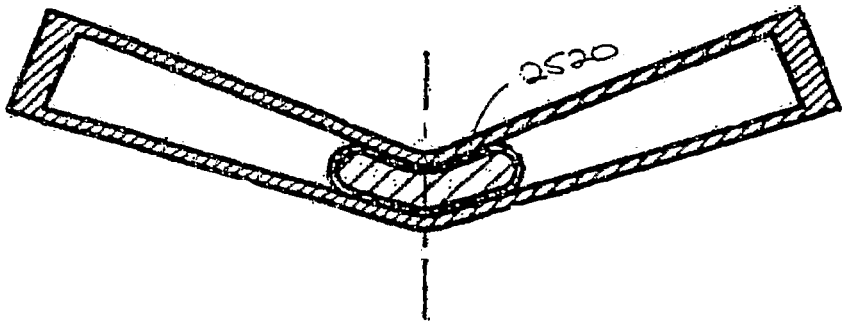
Figure 26A:
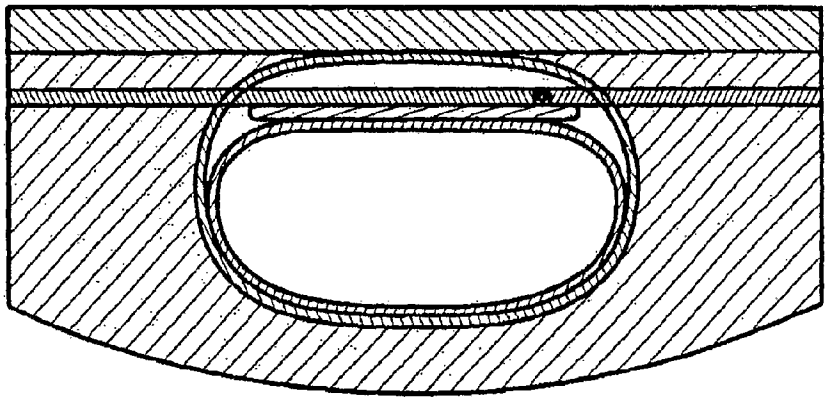
FIGS. 26 and 27 show displacement mechanisms suitable for use in FIG. 23*a;*
Figure 26B:
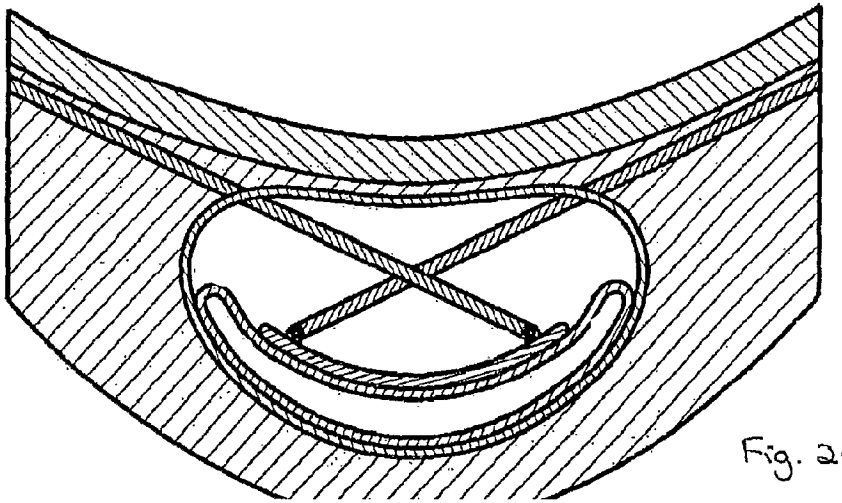
Figure 27:
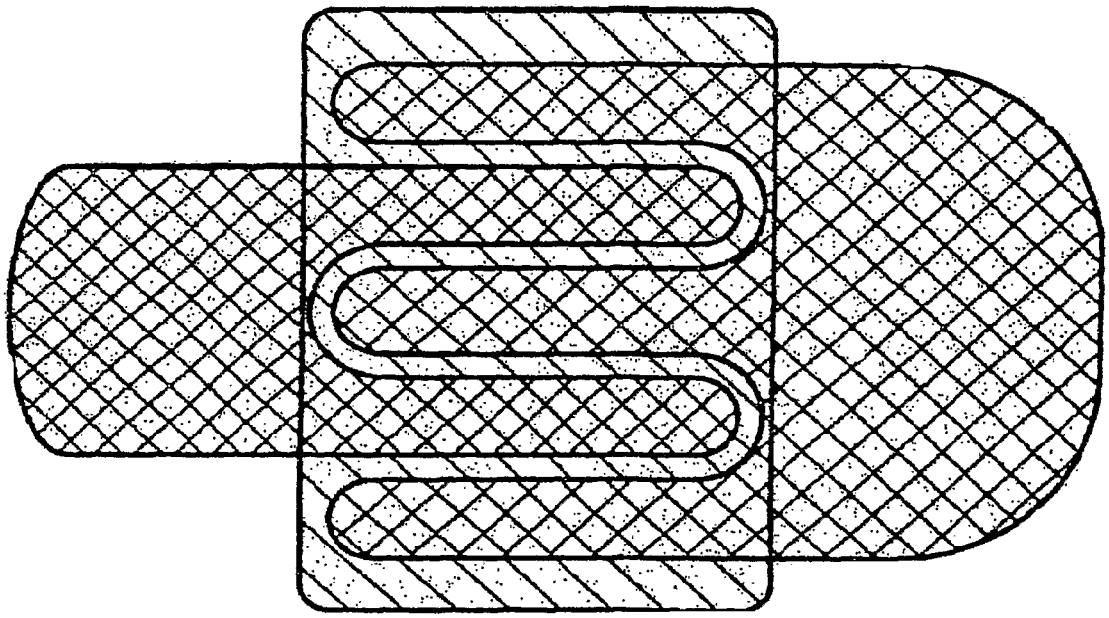

The footwear article in this embodiment is similar to the fourth embodiment in that the operation of the ventilation mechanism primarily depends on the bending of the shoe during walking motion. As shown in FIG. 24, the rib member 2422 may be spaced apart transversely in an alternating manner. FIGS. 26*a* and 26*b* illustrate an alternative construction of rib members. FIG. 27 is another illustration of an alternative actuation means with rib like members.

Note:

In each of our embodiments 1-5, we pump air from the exterior into the footwear cavity. But we can also draw air from the footwear cavity and vent it outside by reversing the direction of the valves.

Feature: Recirculation Control Valve

As one of the supplementary features that help to extend the benefits of the current invention, a recirculation valve is included to regulate the amount of external air allowed for circulation into the footwear. In particular, it is envisaged that in cold weather the wearer may not want to circulate cold air from outside within the footwear.

Figure 28A:
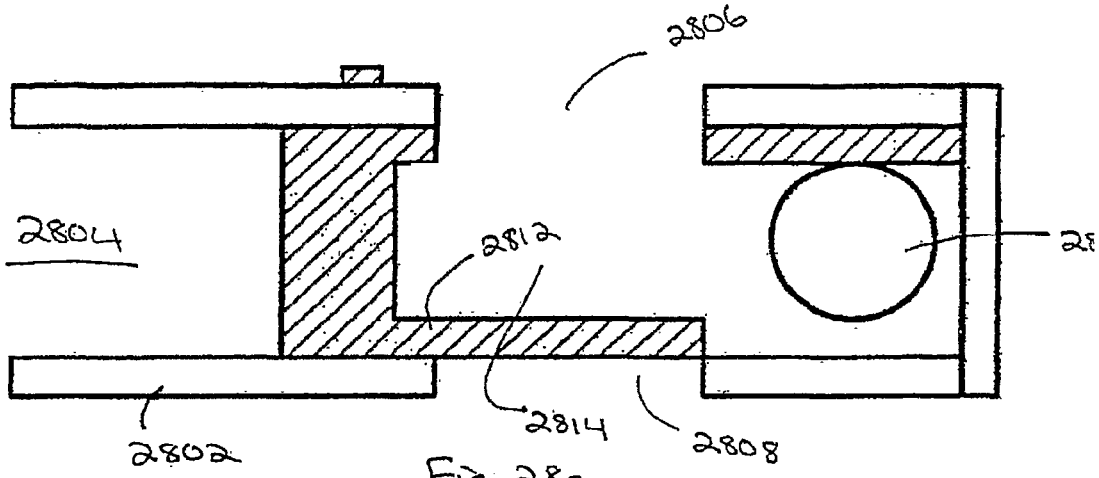
FIGS. 28*a*, 28*b* and 28*c* illustrate a schematic view of recirculation control valve.
Figure 28B:
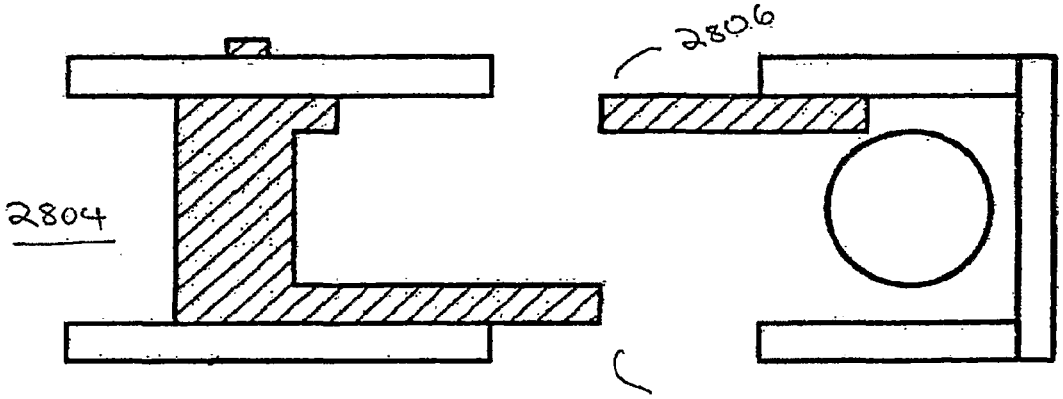
Figure 28C:
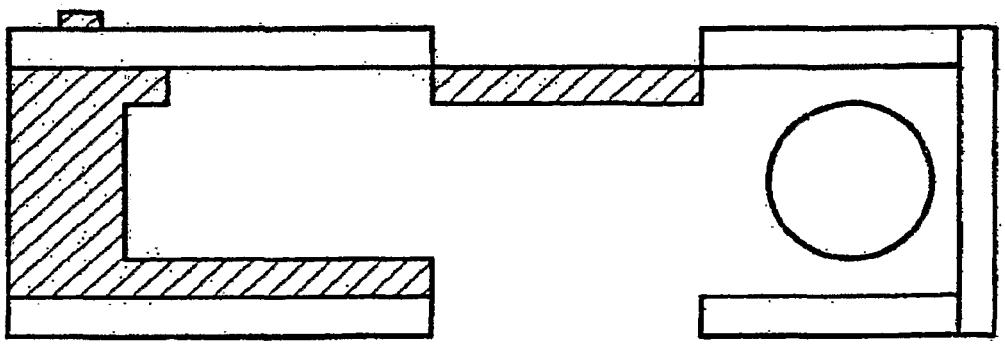

Referring to FIGS. 28*a*, 28*b* and 28*c*, a pump-ventilated footwear article includes a recirculation control valve mechanism that includes a housing 2802 having an elongate aperture 2804, a first inlet port 2806 transversely opposite a second inlet port 2808, an outlet port 2810 at a longitudinal end of the aperture 2804, an internal passage 2814 via which external air or re-circulated air can pass and a valve member 2812 for controlling the passage of air via the valve mechanism. The valve member 2812 is provided with the internal passage 2814 sealingly received for linear sliding movement in the aperture 2804. FIG. 28*a* shows the valve member 2812 in a first position with the passageway 2814 connecting ports 2806 and 2810 where 2806 represents port extending to an external source. FIG. 28*c* shows passageway 2814 connecting ports 2808 and 2810 for drawing in air from an internal source accessible through 2808 and FIG. 28*b* shows an intermediate position drawing air from both ports 2806 and 2808.

Feature: Pump Design

Figures 29A, 29B:
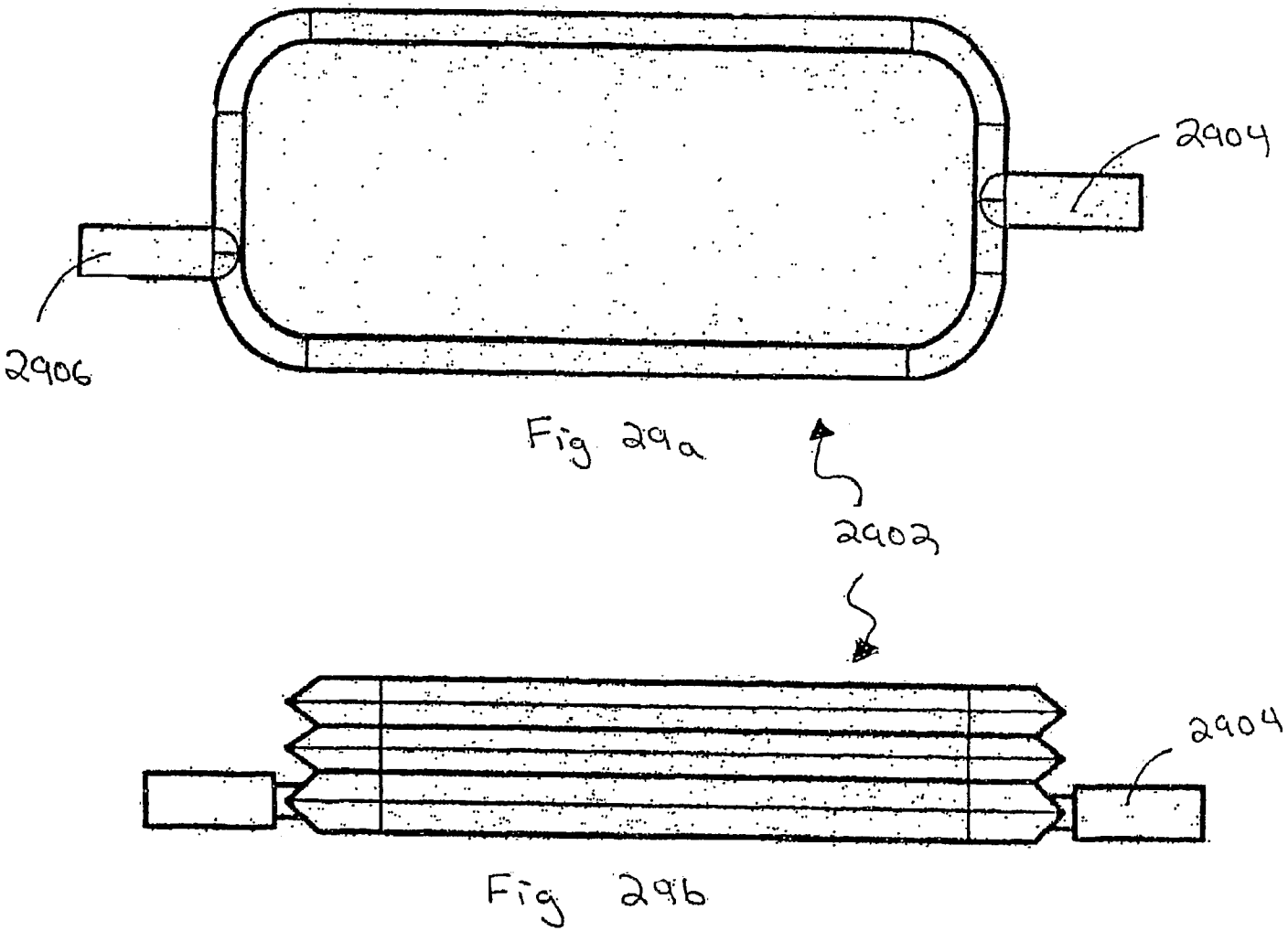
FIGS. 29*a* and 29*b* illustrate a pump member suitable for use in certain embodiments of the current invention.

FIGS. 29*a* and 29*b* depict the top and side views of a pump member 2902 that is particularly suitable for the third and fourth embodiment. The pump is of an elongated design has a back part with a pipe 2904 at the centre with a fore part with the pipe 2906 situated to one side. By situating the outtake pipe at one side, the pump can be more efficiently depressed as the outtake pipe will not block the movement of the spring or springboard acting on it as in the third and fourth embodiment.

Figure 30A:
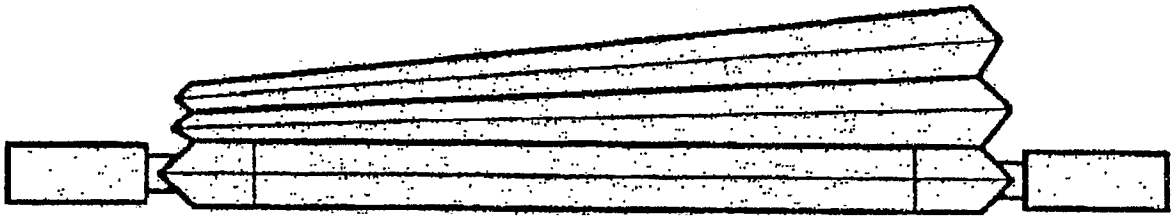
FIGS. 30*a* and 30*b* illustrate an alternative design for a pump member suitable for use in certain embodiments of the current invention.
Figure 30B:
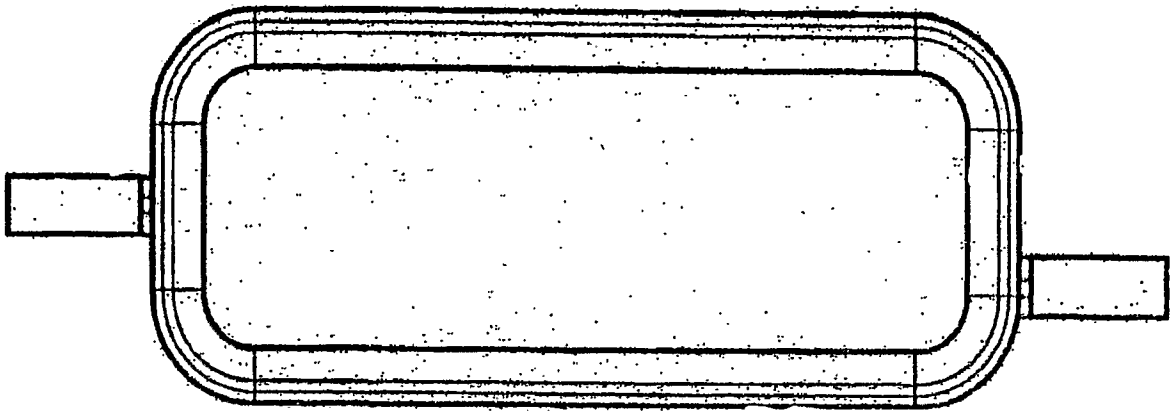

FIGS. 30*a* and 30*b* depict a similar pump member to that in FIGS. 29*a* and 29*b* but one in which the back of the pump is larger than the forepart. This design is particularly suitable for use in the third and fourth embodiment because the angular rotation of the spring member is greater the further away it is from the pivoting point. In turn, the greater angular rotation at the back part of the spring member also causes a greater angular displacement at the back of the pump member.

Feature: Spring Board

Figure 31A:
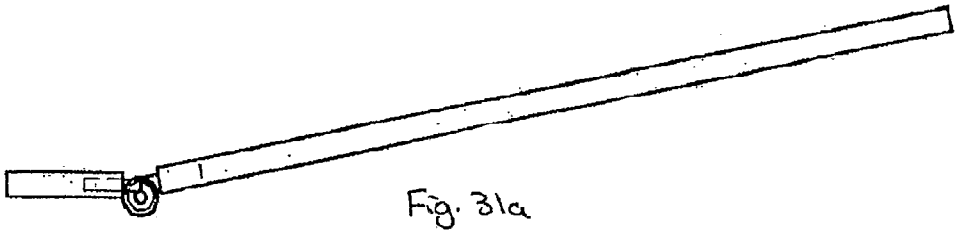
FIG. 31*a* and FIG. 31*b* depict a springboard suitable for use as an actuating member in FIG. 19*a;*
Figure 31B:
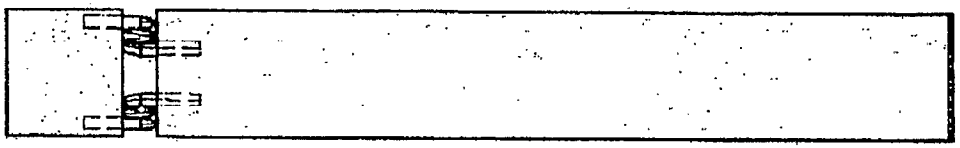

FIGS. 31*a* and 31*b* depict a springboard that would be suitable for use in place of a spring, in the fourth embodiment. The springboard comprises two elongated and relatively rigid boards joined at their ends by one or more spring members biased towards straightening. This design is advantageous over a traditional spring because of its relatively thin profile.

Figure 32A:
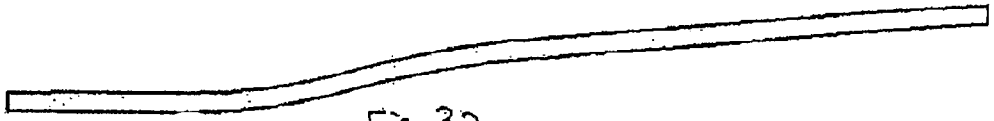
FIG. 32*a* and FIG. 32*b* depict an alternative springboard suitable for use as an actuating member in FIG. 19*a*.
Figure 32B:
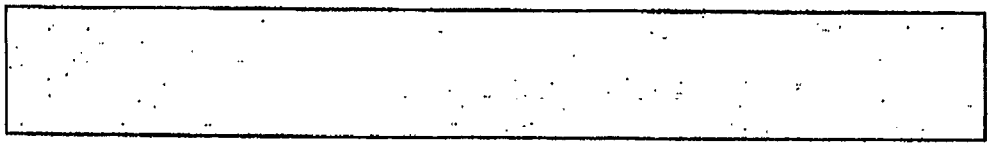

FIGS. 32*a* and 32*b* depict an alternative springboard, made up of a resilient yet relatively rigid material. This design is particularly suitable because it is thin and can be made up of a material other than metal thus rendering it airport safe.

Feature: Temperature-Regulating or Substance Dispensing Mechanism

Figure 33:
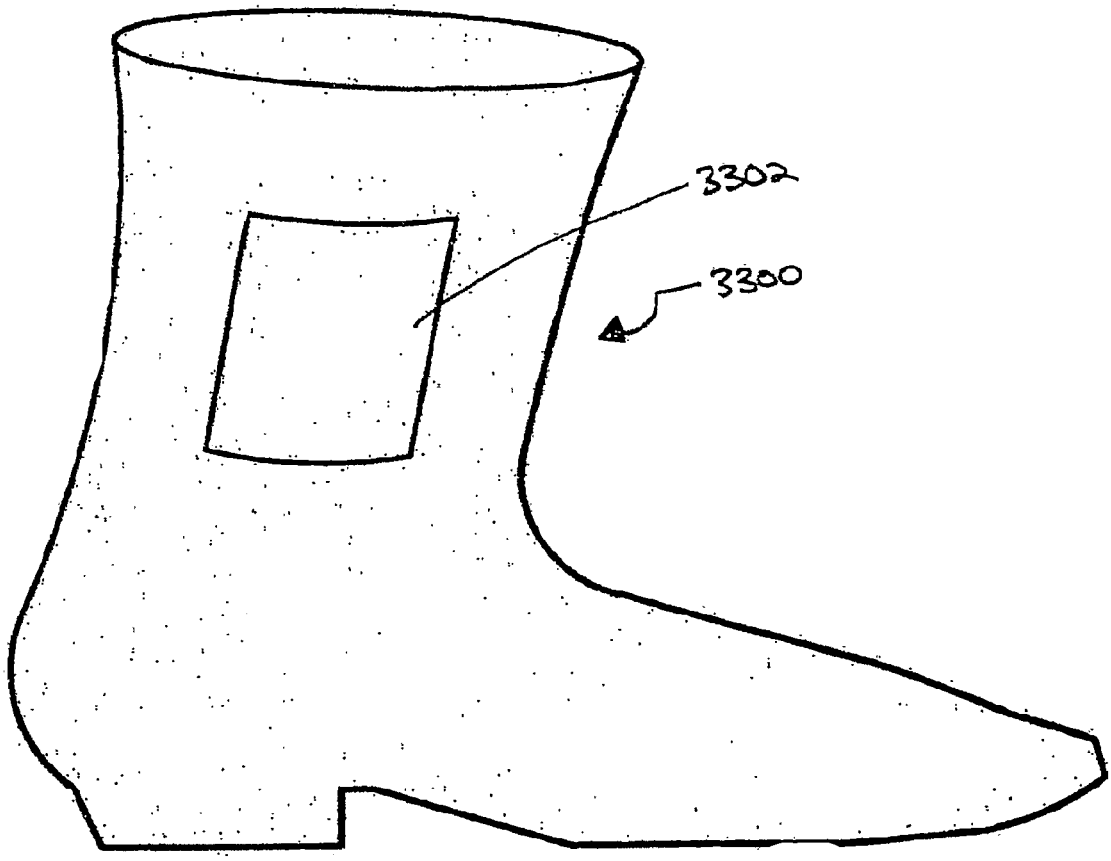
FIG. 33 depicts a footwear article with a chamber for accommodating a temperature-regulating or substance dispensing member.

This feature (FIG. 33) includes a footwear article 3300 provided with a temperature-regulating chamber 3302 or else a chamber for holding a substance to be dispensed inside the footwear via a ventilation or air circulation system. The chamber 3302 is sized and shaped to accommodate a heat-regulating member or substance dispenser such as a heat pad or a deodorant. The 3302 is connected with the shoe cavity via passageways (not shown) such that warm or scented air generated in the chamber can be drawn to the shoe cavity. This feature may be applied to the previous embodiments such that the warm or scented air can actively be drawn to the shoe cavity during walking motion.

The invention claimed is:

1. An article of footwear comprising:

a shoe body including a shoe upper and a sole including a bendable portion which together define a first cavity;

said sole comprising a second cavity;

at least one pump positioned in the second cavity;

an actuation member comprising a first end and a second end opposite the first end, and the actuation member positioned inside said sole;

the actuation member comprising a rotation region at which the second end of the actuation member is rotated relative to the first end of the actuation member; and the second end of the actuation member is a movable free end with respect to the first end and actuates the pump member by pressing or pulling against said pump member within the second cavity in response to bending or unbending of said sole.

2. The article of footwear as claimed in claim 1, wherein said sole includes:

a front portion;

a mid portion;

a rear portion;

said sole configured to bend at or near said mid portion in response to or during walking motion and said actuation member includes a front segment residing in said front portion and a rear segment residing in said rear portion, wherein said rotation region connects said front segment and said rear segment.

3. The article of footwear as claimed in claim 2, wherein said sole comprises an insole and an outsole and said pump resides between said insole and said outsole at or near said rear portion.

4. The article of footwear as claimed in claim 2, wherein said sole comprises an insole and an outsole and said pump resides between said insole and said outsole at or near said front portion.

5. The article of footwear as claimed in claim 1, wherein said pump includes a front region and a rear region, and wherein said front region is substantially thinner than said rear region.

6. The article of footwear as claimed in claim 1, wherein said pump is provided with air passageways and valves in communication with the first cavity and/or the surroundings of said footwear article.

7. The article of footwear as claimed in claim 1, wherein said pump is enclosed in an airtight chamber arranged in said sole and wherein said chamber is provided with air passageways and control valves in communication with the first cavity and/or surroundings of said footwear article.

8. The article of footwear as claimed in claim 1, wherein said sole comprises an insole and an outsole and said pump resides between said insole and said outsole at or near said rotation region.

9. The article of footwear in claim 8 comprising two said pumps, one of which is located above the free end of said actuation member and the said other pump is located below the free end of said actuation member.

10. The article of footwear as claimed in claim 1, wherein said rotation region of the actuation member includes a spring, a springboard or a rigid board for urging the actuation member toward the pump.

11. The article of footwear as claimed in claim 1, wherein said footwear article comprises a control valve connected to a passageway of said pump for controlling the ratio of the amount of air receivable from the first cavity and the amount of air receivable from surroundings of said footwear article.

12. The article of footwear as claimed in claim 1, further comprising a chamber for accommodating a temperature-regulating or substance dispensing member, wherein said chamber is connected to the first and/or second cavity.

13. The article of footwear as claimed in claim 12, further comprising a temperature-regulating or substance dispensing member.

14. The article of footwear as claimed in claim 1, wherein said sole includes an insole and an outsole together defining said second cavity therebetween and having a front portion and a rear portion, with said pump residing in said rear portion, and wherein said sole is made of relatively rigid material whereby in use the relative distance between said insole and said outsole at said rear portion remains essentially constant during movement of air into and/or out of the cavity.

* * * * *

UNITED STATES PATENT AND TRADEMARK OFFICE

CERTIFICATE OF CORRECTION

PATENT NO. : 8,505,214 B2
APPLICATION NO. : 11/995293
DATED : August 13, 2013
INVENTOR(S) : Ka Shek Neville Lee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1193 days.

Signed and Sealed this
Fifteenth Day of September, 2015

Michelle K. Lee

Michelle K. Lee
*Director of the United States Patent and Trademark Office*